US011730273B2

(12) United States Patent
Levinson et al.

(10) Patent No.: US 11,730,273 B2
(45) Date of Patent: Aug. 22, 2023

(54) CUP HOLDER FOR COUCHES AND SOFAS

(71) Applicant: STUD PRODUCTS, LLC, Littleton, CO (US)

(72) Inventors: Michael Levinson, Littleton, CO (US); Jennifer Levinson, Littleton, CO (US)

(73) Assignee: STUD PRODUCTS, LLC, Littleton, CO (US)

( * ) Notice: Subject to any disclaimer, the term of this patent is extended or adjusted under 35 U.S.C. 154(b) by 78 days.

(21) Appl. No.: 17/472,428

(22) Filed: Sep. 10, 2021

(65) Prior Publication Data

US 2022/0248858 A1 Aug. 11, 2022

Related U.S. Application Data

(63) Continuation-in-part of application No. 29/769,572, filed on Feb. 5, 2021.

(51) Int. Cl.

| | |
|---|---|
| ***F16M 11/28*** | (2006.01) |
| ***F16M 11/04*** | (2006.01) |
| ***A47C 21/00*** | (2006.01) |
| ***A47C 7/62*** | (2006.01) |

(52) U.S. Cl.
CPC ..... *A47C 7/622* (2018.08)

(58) Field of Classification Search
CPC ..... A47C 31/00; A47C 7/622
See application file for complete search history.

(56) References Cited

U.S. PATENT DOCUMENTS

| | | | | |
|---|---|---|---|---|
| 4,079,536 | A * | 3/1978 | Hunt | F41A 9/85 42/89 |
| D248,719 | S | 8/1978 | Broyles | |
| D272,506 | S | 2/1984 | Steiner | |
| 5,038,434 | A * | 8/1991 | Navarrette | A47B 23/025 5/426 |
| D337,027 | S | 7/1993 | Malatok | |
| D376,733 | S | 12/1996 | Bellisario | |
| D550,981 | S * | 9/2007 | Watson, Sr. | D6/663 |
| 7,731,144 | B2 * | 6/2010 | Kazyaka | B60N 3/107 248/346.11 |

(Continued)

OTHER PUBLICATIONS

U.S. Restriction Requirement for U.S. Appl. No. 29/769,572 dated Dec. 27, 2022.

*Primary Examiner* — Shin H Kim
(74) *Attorney, Agent, or Firm* — Sherman IP LLP; Kenneth L. Sherman; Hemavathy Perumal

(57) ABSTRACT

One embodiment provides a cup holder device comprising a receptacle. The receptacle comprises an inner portion including a hollow recess with an open mouth at a top of the receptacle, an interior base wall defining a bottom of the hollow recess, and an interior surrounding sidewall extending vertically between the open mouth and the interior base wall. The inner portion is shaped to receive and retain a drinking vessel. The receptacle further comprises an outer portion including an exterior surrounding sidewall. The cup holder device further comprises an arm extending downwardly from a bottom of the receptacle. The arm is shaped to insert in between one or more portions of a seating area. The outer portion makes direct contact with and rests on top of the one or more portions of the seating area when the arm is inserted in between the one or more portions of the seating area.

14 Claims, 34 Drawing Sheets

(56) References Cited

U.S. PATENT DOCUMENTS

| | | | | |
|---|---|---|---|---|
| D637,460 | S | 5/2011 | Tussy | |
| 9,016,651 | B2 * | 4/2015 | Webb | A47G 23/0225 248/311.2 |
| 9,722,440 | B2 * | 8/2017 | Webb | A47C 21/00 |
| 9,924,805 | B2 * | 3/2018 | Cass | A47C 31/00 |
| D927,913 | S * | 8/2021 | Yoo | D7/326 |
| 11,124,103 | B1 * | 9/2021 | Russell | B60N 3/103 |
| 2005/0184074 | A1 * | 8/2005 | Simmons | B65D 81/3869 220/592.17 |
| 2006/0042970 | A1 * | 3/2006 | Galuten | B65D 83/0805 206/233 |
| 2011/0094155 | A1 * | 4/2011 | Tompkins | A01G 13/10 119/28.5 |
| 2011/0259949 | A1 * | 10/2011 | Omdoll | A47F 1/085 229/104 |
| 2011/0265374 | A1 * | 11/2011 | Tompkins, IV | A01K 15/025 119/711 |
| 2012/0112019 | A1 * | 5/2012 | Webb | A47G 23/02 248/121 |
| 2014/0131530 | A1 * | 5/2014 | Webb | A47G 23/02 248/149 |
| 2014/0239134 | A1 * | 8/2014 | Webb | A47G 23/0225 248/125.3 |
| 2016/0190838 | A1 * | 6/2016 | Webb | H02J 7/0044 211/133.1 |
| 2020/0398726 | A1 * | 12/2020 | Frye | F16F 15/22 |
| 2021/0101514 | A1 * | 4/2021 | Matteucci | B60N 3/105 |
| 2021/0245646 | A1 * | 8/2021 | MacNeil | B60N 3/107 |
| 2022/0227574 | A1 * | 7/2022 | Oh | B65D 85/8046 |
| 2022/0248858 | A1 * | 8/2022 | Levinson | A47C 7/622 |
| 2022/0287490 | A1 * | 9/2022 | Singleton | B60N 3/107 |

* cited by examiner

100

300

300

CUP HOLDER FOR COUCHES AND SOFAS

CROSS REFERENCE TO RELATED APPLICATIONS

This application is a continuation-in-part of U.S. Non-Provisional Design Patent Application No. 29/769,572, filed on Feb. 5, 2021, all incorporated herein by reference.

TECHNICAL FIELD

One or more embodiments relate generally to cup holders, and in particular, cup holders configured and adapted to function for use with couches and sofas.

BACKGROUND

A cup holder is a device to hold a cup or other drinking vessel.

SUMMARY

One embodiment provides a cup holder device comprising a receptacle. The receptacle comprises an inner portion including a hollow recess with an open mouth at a top of the receptacle, an interior base wall defining a bottom of the hollow recess, and an interior surrounding sidewall extending vertically between the open mouth and the interior base wall. The inner portion is shaped to receive and retain a drinking vessel. The receptacle further comprises an outer portion including an exterior surrounding sidewall. The cup holder device further comprises an arm extending downwardly from a bottom of the receptacle. The arm is shaped to insert in between one or more portions of a seating area. The outer portion makes direct contact with and rests on top of the one or more portions of the seating area when the arm is inserted in between the one or more portions of the seating area.

These and other features, aspects and advantages of the present invention will become understood with reference to the following description, appended claims and accompanying figures.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention together with advantages and features, by way of example with reference to the drawings.

DETAILED DESCRIPTION

One or more embodiments relate generally to cup holders, and in particular, cup holders configured and adapted to function for use with couches and sofas. One embodiment provides a cup holder device comprising a receptacle. The receptacle comprises an inner portion including a hollow recess with an open mouth at a top of the receptacle, an interior base wall defining a bottom of the hollow recess, and an interior surrounding sidewall extending vertically between the open mouth and the interior base wall. The inner portion is shaped to receive and retain a drinking vessel. The receptacle further comprises an outer portion including an exterior surrounding sidewall. The cup holder device further comprises an arm extending downwardly from a bottom of the receptacle. The arm is shaped to insert in between one or more portions of a seating area. The outer portion makes direct contact with and rests on top of the one or more portions of the seating area when the arm is inserted in between the one or more portions of the seating area.

Examples of different types of drinking vessels include, but are not limited to, cups, mugs, drink bottles (e.g., glass bottles, plastic bottles), tumblers, drink cans (e.g., aluminum cans), glasses, canteens, flasks, drink containers (e.g., insulated containers), etc.

Figure 1:
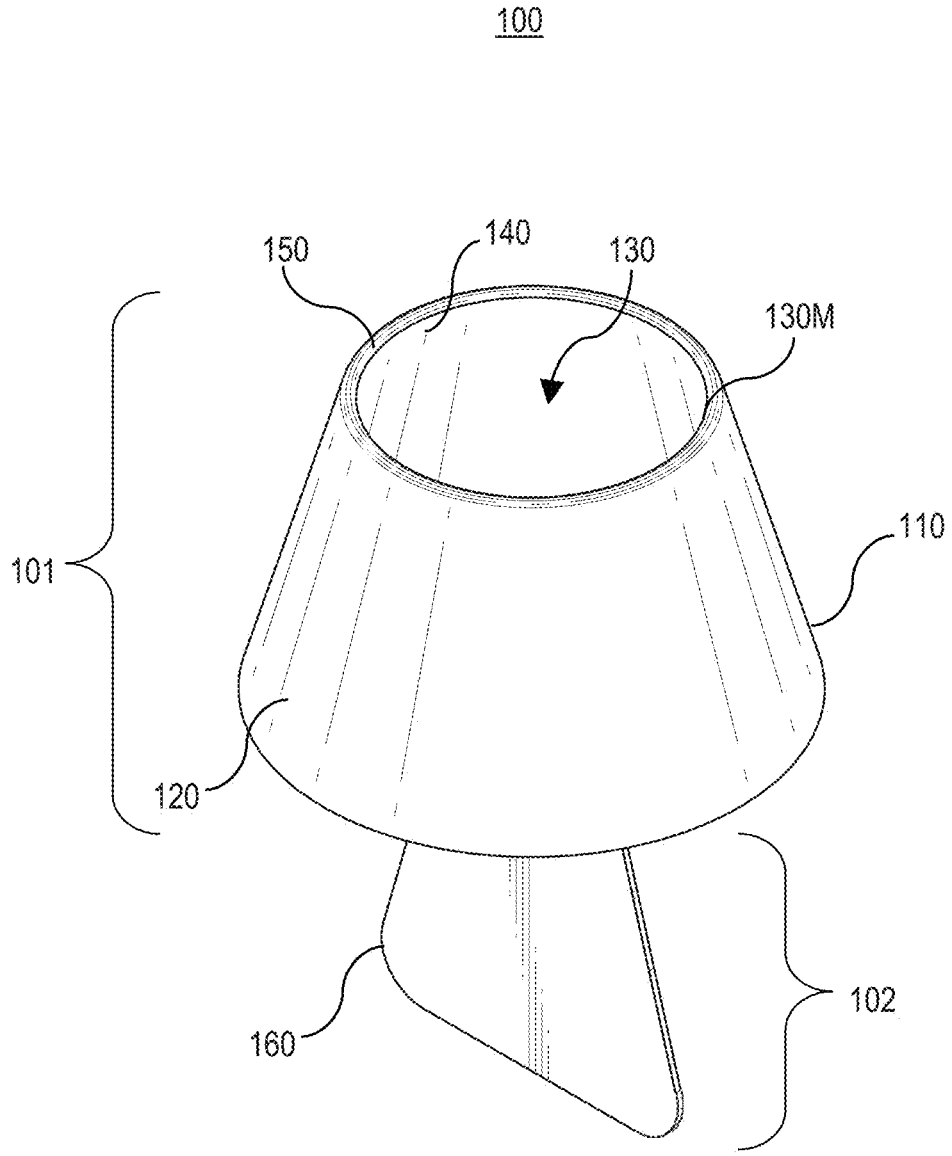
FIG. 1 is a perspective view of a first cup holder, in accordance with one embodiment.
Figure 2:
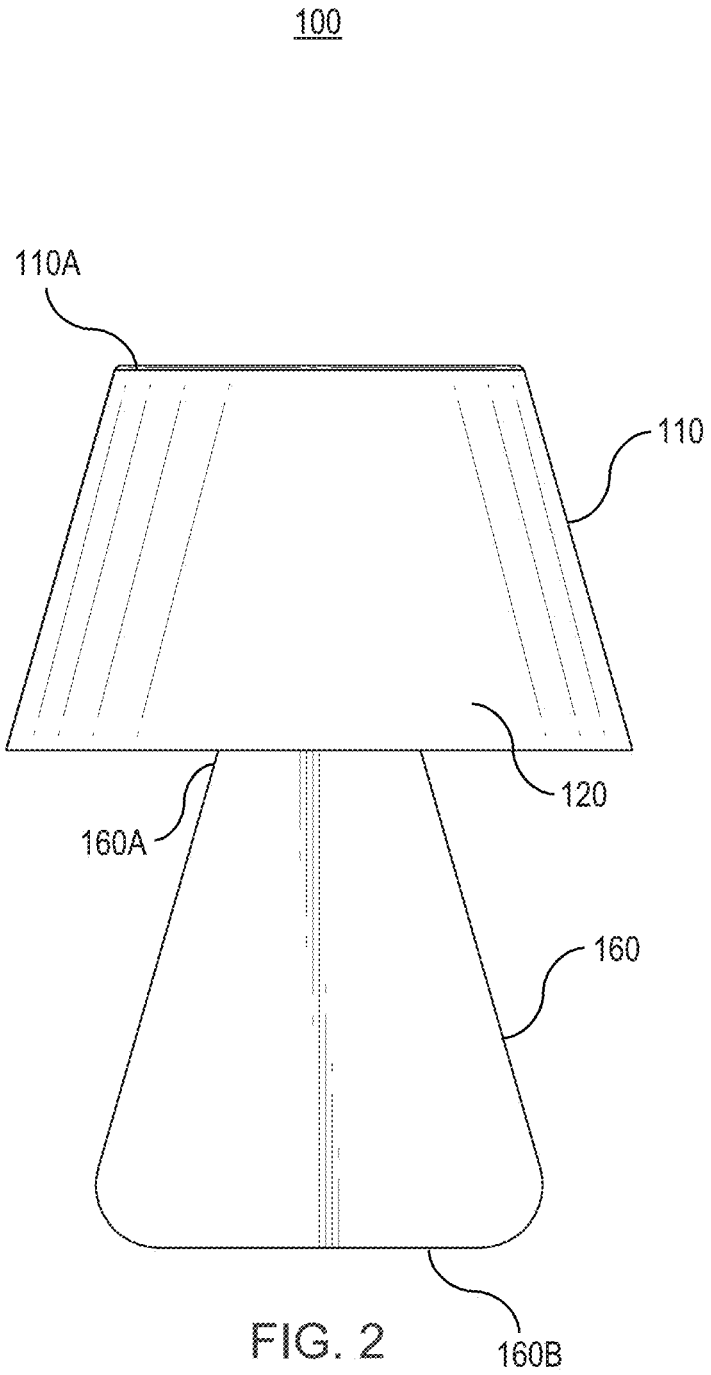
FIG. 2 is a side view of the first cup holder shown in FIG. 1, in accordance with one embodiment.
Figure 3:
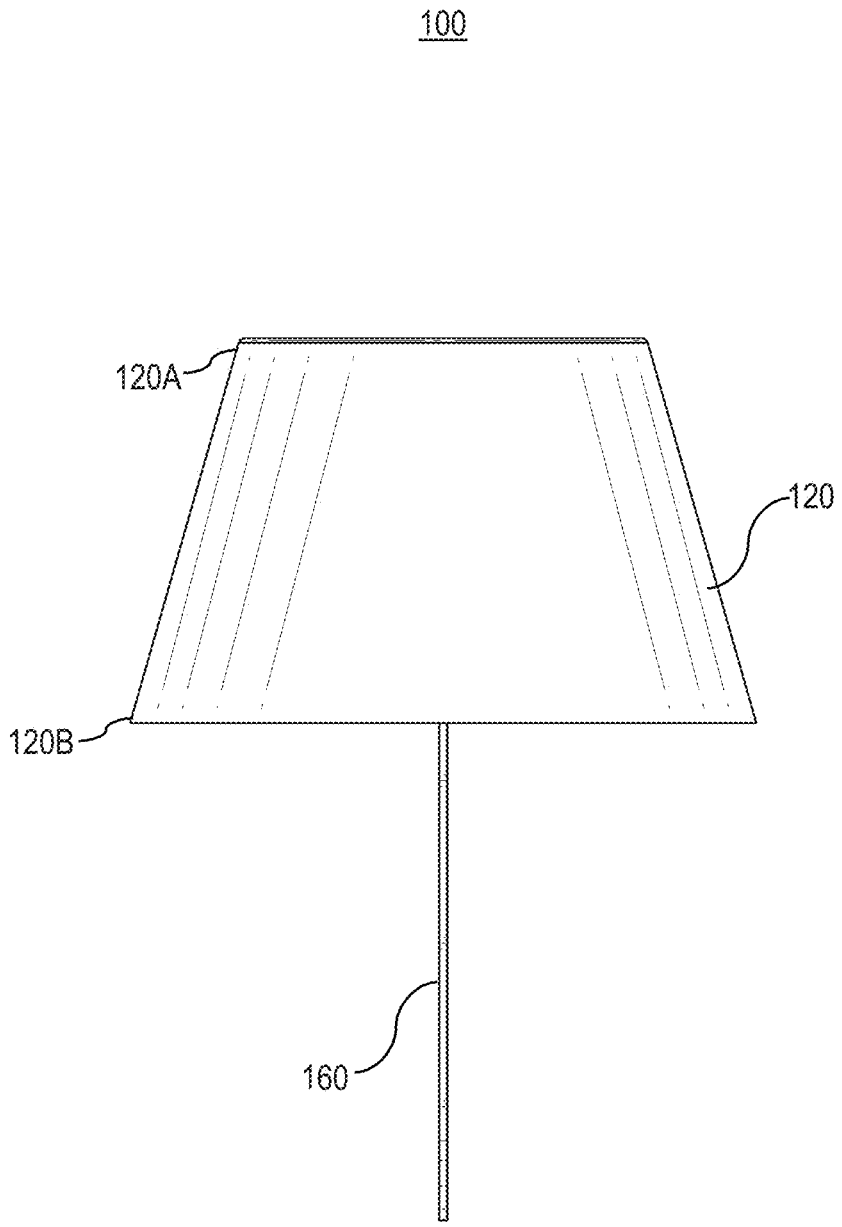
FIG. 3 is another side view of the first cup holder shown in FIG. 1, in accordance with one embodiment.
Figure 4:
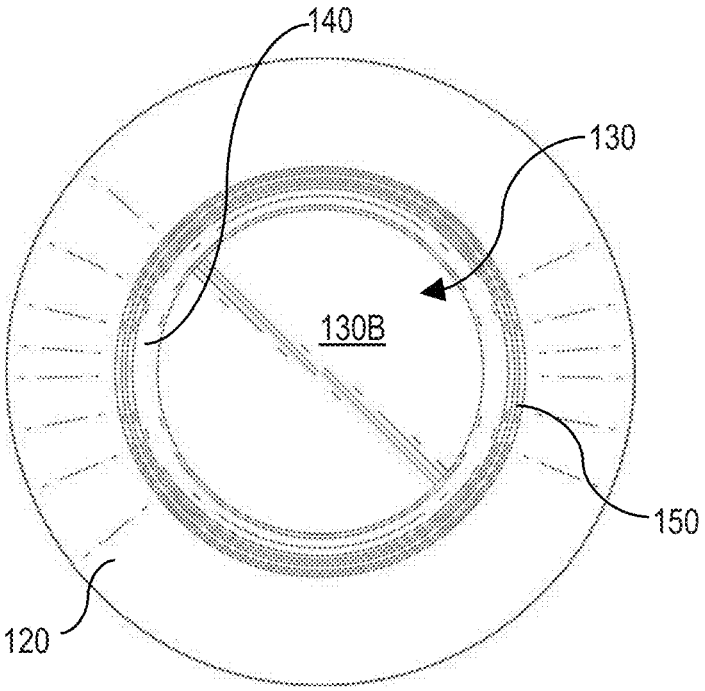
FIG. 4 is a top plan view of the first cup holder shown in FIG. 1, in accordance with one embodiment.
Figure 5:
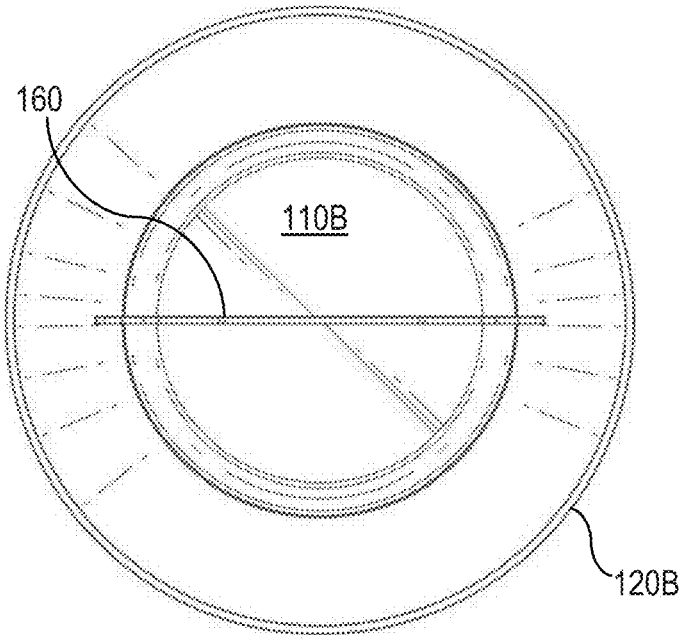
FIG. 5 is a bottom plan view of the first cup holder shown in FIG. 1, in accordance with one embodiment.

FIGS. 1-5 are different views of a cup holder 100, in accordance with one embodiment. FIG. 1 is a perspective view of the cup holder 100, in accordance with one embodiment. FIG. 2 is a side view of the cup holder 100, in accordance with one embodiment. FIG. 3 is another side view of the cup holder 100, in accordance with one embodiment. FIG. 4 is a top plan view of the cup holder 100. FIG. 5 is a bottom plan view of the cup holder 100, in accordance with one embodiment. In one embodiment, the cup holder 100 comprises an upper end 101 and a lower end 102. The upper end 101 comprises a receptacle 110 inside of which a drinking vessel may be removably placed to contain the drinking vessel. The receptable 110 is designed and shaped to receive and contain different sizes and types of drinking vessels.

In one embodiment, the receptacle 110 comprises a hollow recess 130 with an open mouth 130M at a top 110A of the receptacle 110, an interior surrounding sidewall 140 below the open mouth 130M, and a substantially planar (i.e., flat) interior base wall 130B defining a bottom of the hollow recess 130. The interior surrounding sidewall 140 extends vertically between the open mouth 130M and the interior base wall 130B. The interior base wall 130B extends horizontally across the bottom of the hollow recess 130. The hollow recess 130, the interior surrounding sidewall 140, and the interior base wall 130B define an inner portion of the receptacle 110. The interior base wall 130B defines an interior surface of a bottom 110B of the receptacle 110.

The open mouth 130M is designed and shaped to receive a portion of a drinking vessel (e.g., a portion of a drinking vessel that includes a bottom of the drinking vessel). In one embodiment, the open mouth 130M is substantially circular with a diameter that is sized to receive a substantially cylindrical drinking vessel. For example, in one embodiment, the diameter of the open mouth 130M is substantially within a range of about 3 inches to about 4 inches.

The hollow recess 130, the interior surrounding sidewall 140, and the interior base wall 130B are designed and shaped to securely contain a portion of a drinking vessel (e.g., a portion of a drinking vessel that includes a bottom of the drinking vessel). In one embodiment, the interior surrounding sidewall 140 and the hollow recess 130 are substantially cylindrical and the interior base wall 130B is substantially circular, all with a depth (or height) and/or a diameter that is sized to securely contain a substantially cylindrical drinking vessel of various sizes. For example, in one embodiment, the diameter of the interior base wall 130B, the diameter of the interior surrounding sidewall 140, and the diameter of the hollow recess 130 are substantially within a range of about 3 inches to about 4 inches. For example, in one embodiment, the depth (or height) of the interior surrounding sidewall 140 and the depth (or height) of the hollow recess 130 are substantially within a range of about 3 inches to about 3¼ inches. In one embodiment, the interior surrounding sidewall 140 is formed of a single continuous piece or of a plurality of separate pieces.

In one embodiment, the receptacle 110 further comprises a rim 150 defining a periphery of the open mouth 130M, and an exterior surrounding sidewall 120 extending downwardly from the rim 150. The rim 150 and the exterior surrounding sidewall 120 define an outer portion of the receptacle 110. In one embodiment, a thickness of the rim 150 varies. For example, in one embodiment, the thickness of the rim 150 is substantially within a range of about 2 cm to 3 cm.

In one embodiment, a bottom 120B of the exterior surrounding sidewall 120 is substantially coplanar with the bottom 110B of the receptacle 110. In another embodiment, the bottom 120B of the exterior surrounding sidewall 120 extends beyond the bottom 110B of the receptacle 110.

In one embodiment, the exterior surrounding sidewall 120 is substantially cylindrical. A diameter of the exterior surrounding sidewall 120 is larger than the diameter of the interior surrounding sidewall 140 and the hollow recess 130. In one embodiment, a thickness of the exterior surrounding sidewall 120 varies.

In one embodiment, the exterior surrounding sidewall 120 is flared, such that the exterior surrounding sidewall 120 outwardly tapers as the exterior surrounding sidewall 120 extends downwardly from the rim 150. The diameter of the exterior surrounding sidewall 120 increases as the exterior surrounding sidewall 120 extends downwardly, i.e., the diameter at a top 120A of the exterior surrounding sidewall 120 is narrower than the diameter at the flared bottom 120B of the exterior surrounding sidewall 120. The flared bottom 120B defines the widest part of the receptacle 110 which in turn defines the widest part of the entire cup holder 100. In one embodiment, the diameter of the exterior surrounding sidewall 120 at the flared bottom 120B (i.e., the diameter/width of the widest part of the receptacle 110/the entire cup holder 100) varies depending on an amount of stability required (e.g., the diameter is wider if more stability is required). For example, in one embodiment, the diameter of the exterior surrounding sidewall 120 at the flared bottom 120B (i.e., the diameter/width of the widest part of the receptacle 110/the entire cup holder 100) is substantially within a range of about 4½ inches to about 5½ inches. In one embodiment, the exterior surrounding sidewall 120 is formed of a single continuous piece or of a plurality of separate pieces.

The receptacle 110 is designed and shaped to receive a portion of a drinking vessel (e.g., a bottom half of a drinking vessel) via the open mouth 130M, and securely retain the portion of the drinking vessel inside the receptacle 110 (i.e., inside the inner portion of the receptacle 110). The depth (or height) and/or the diameter of the hollow recess 130, the interior surrounding sidewall 140, and the interior base wall 130B are sized to securely engage and retain the portion of the drinking vessel. The interior surround sidewall 140 maintains the drinking vessel in an upright position and restricts movement of the drinking vessel, thereby preventing the drinking vessel from tipping and in turn reducing or preventing spillage of any liquids contained inside the drinking vessel.

In one embodiment, the lower end 102 comprises a downwardly extending arm 160 extending from the bottom 110B of the receptacle 110. In one embodiment, a top 160A of the downwardly extending arm 160 is attached or connected to a center of an exterior surface of the bottom 110B of the receptacle 110.

In one embodiment, the downwardly extending arm 160 is designed and shaped to be removably inserted (i.e., wedged) in between one or more portions of a seating area, such as a sofa or a couch, to securely retain the cup holder 100 in an upright position. In one embodiment, a thickness of the downwardly extending arm 160 varies based on an amount of gap or space in between the one or more portions of the seating area (e.g., the thickness is thicker if the gap or space is wider). For example, in one embodiment, the downwardly extending arm 160 is designed and shaped to be removably inserted (i.e., wedged) in between a pair of seat cushions or seat pads of a seating area (e.g., sofa or couch cushions of a sofa or couch). As another example, in one embodiment, the downwardly extending arm 160 is designed and shaped to be removably inserted (i.e., wedged) in between an arm rest and a seat cushion or seat pad of a seating area. As yet another example, in one embodiment, the downwardly extending arm 160 is designed and shaped to be removably inserted (i.e., wedged) in between any pair of cushions, pillows, or pads (e.g., floor cushions or pillows positioned on a floor, pillows positioned on a bed etc.).

To securely retain the cup holder 100 in an upright position, the downwardly extending arm 160 is inserted in between one or more portions of a seating area (e.g., in between sofa cushions of a sofa) until the bottom 110B of the receptacle 110 and/or the flared bottom 120B of the exterior surrounding sidewall 120 makes direct contact with and rests on top of the one or more portions of the seating area (e.g., rests on top of the sofa cushions). The flared bottom 120B of the exterior surrounding sidewall 120 functions as a support base for the receptacle 110 to maintain its position on the top of the one or more portions of the seating area. For example, if a portion of a drinking vessel is placed inside the receptable 110, a weight of the drinking vessel causes the flared bottom 120B to press/push against the top of the one or more portions of the seating area, thereby anchoring the receptacle 110. The diameter of the exterior surrounding sidewall 120 at the flared bottom 120B is wide enough to stabilize the receptacle 110 and prevent the entire receptacle 110 from falling into a gap or space in between the one or more portions of the seating area. In one embodiment, an underside of the bottom 110B and/or the flared bottom 120B includes one or more non-abrasive detachable attachment mechanisms, such as gripping pads or strips, to detachably attach the bottom 110B and/or the flared bottom 120B to the top of the one or more portions of the seating area.

In one embodiment, the height of the entire cup holder 100 (including the receptacle 110 and the downwardly extending arm 160) is sized to securely contain a drinking vessel of various sizes. For example, in one embodiment, the height of the entire cup holder 100 is substantially within a range of about 7 inches to about 7½ inches. For example, in one embodiment, the depth (or height) of the receptacle 110 is substantially within a range of about 3 inches to about 3½ inches.

In one embodiment, the downwardly extending arm 160 is substantially triangular and tapers outwardly as the downwardly extending arm 160 extends downwardly from the center of the bottom 110B of the receptacle 110. A width of the downwardly extending arm 160 increases as the downwardly extending arm 160 extends downwardly, i.e., the width at a top 160A of the downwardly extending arm 160 is narrower than the width at a bottom 160B of the downwardly extending arm 160. A height and a width of the downwardly extending arm 160 are sized to reduce a likelihood of the cup holder 100 becoming dislodged from a seating area when there is movement around one or more portions of the seating area that the downwardly extending arm 160 is inserted in between. For example, in one embodiment, the height of the downwardly extending arm 160 is substantially about 4 inches, the width of the downwardly extending arm 160 at the top 160A is substantially within a range of about 1½ inches to about 2 inches, and the width of the downwardly extending arm 160 at the bottom 160B is substantially about 3½ inches.

In one embodiment, the bottom 160B of the downwardly extending arm 160 has rounded corners as a safety feature (instead of sharp corners).

Figure 6:
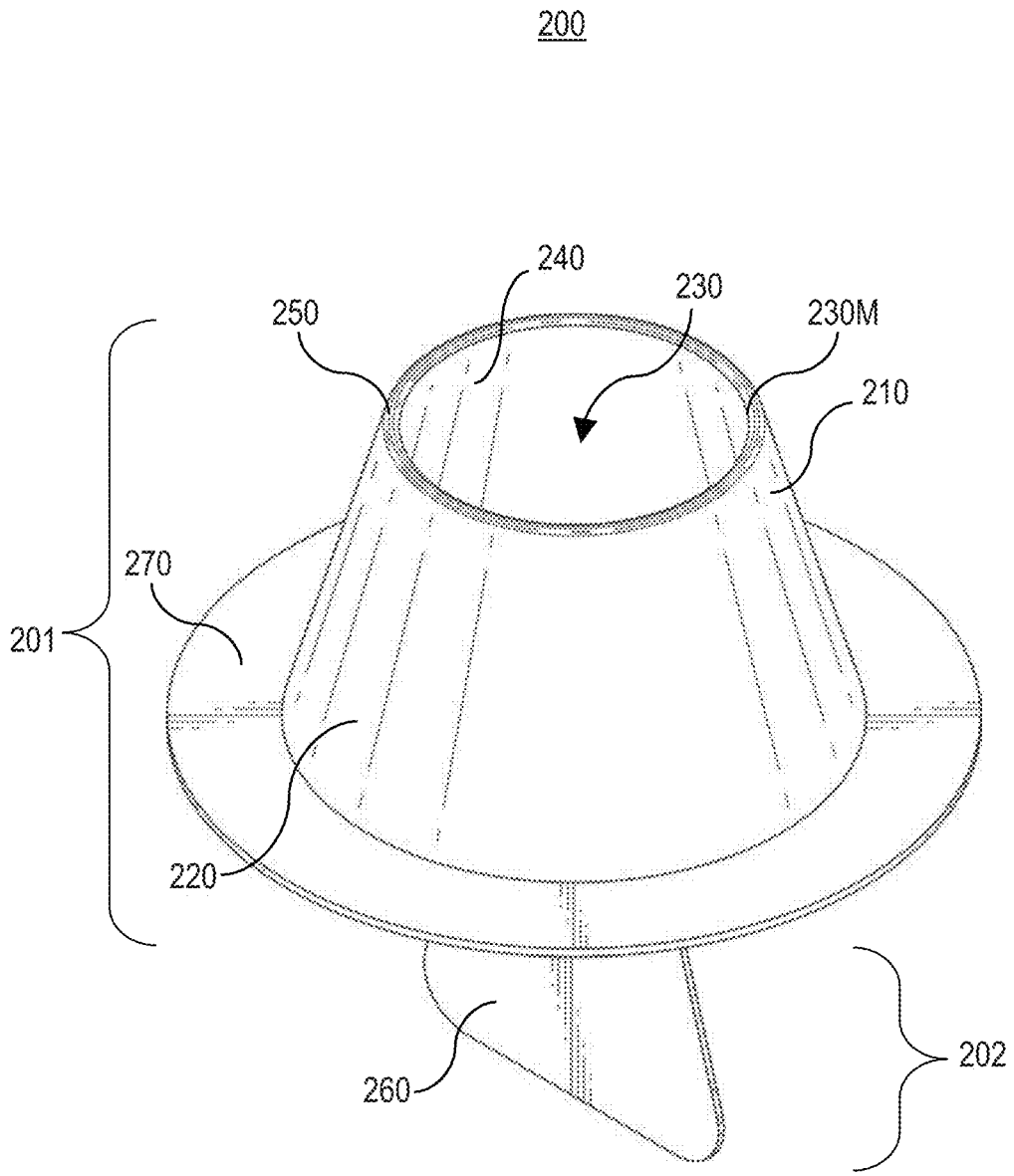
FIG. 6 is a perspective view of a second cup holder, in accordance with one embodiment.
Figure 7:
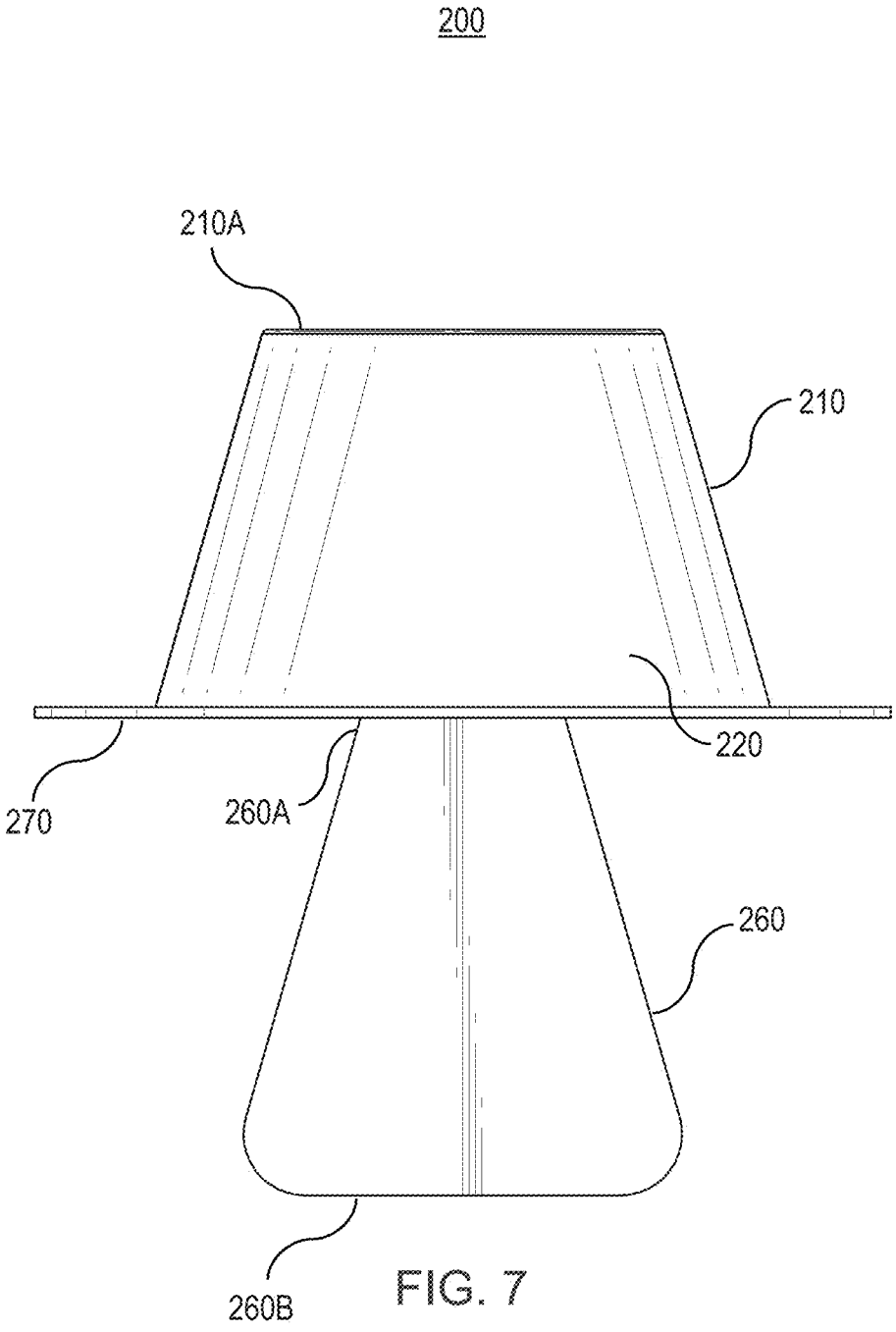
FIG. 7 is a side view of the second cup holder shown in FIG. 6, in accordance with one embodiment.
Figure 8:
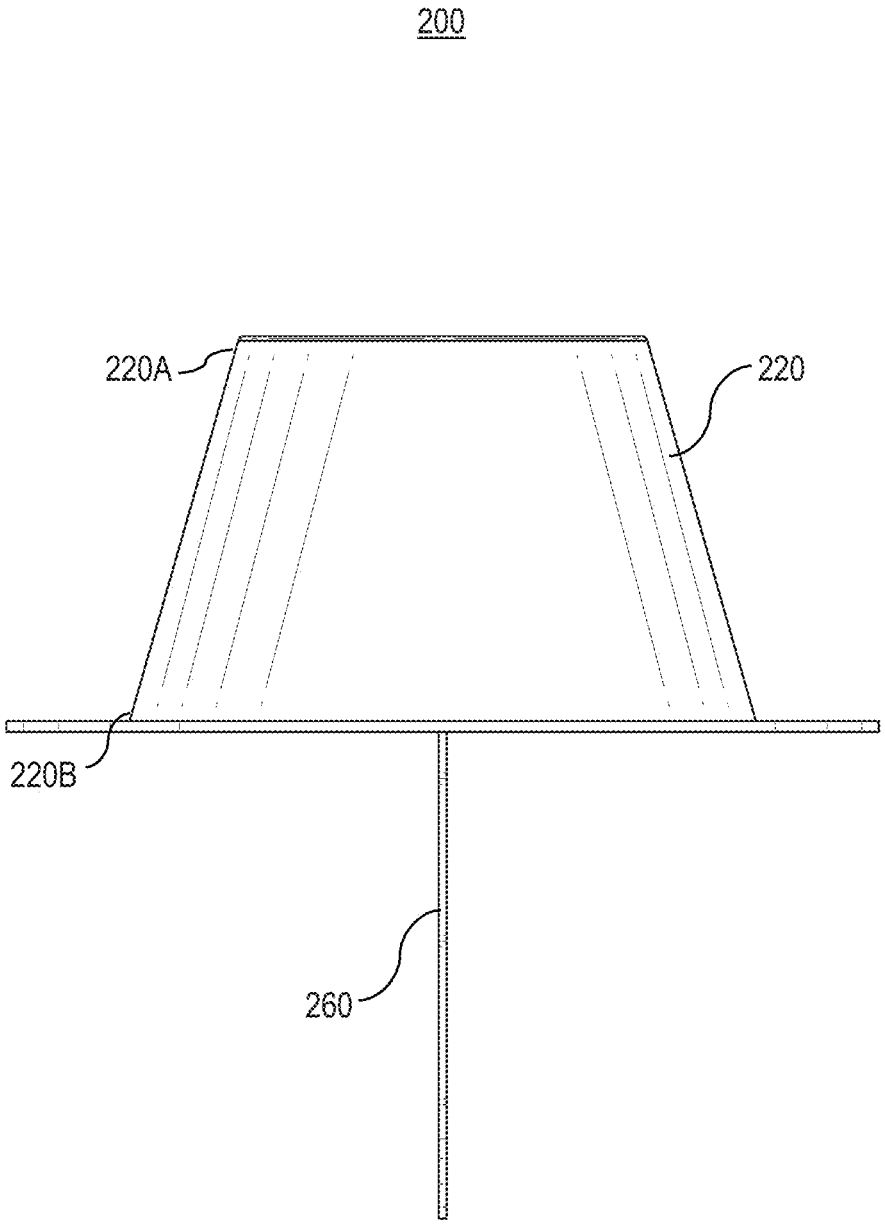
FIG. 8 is another side view of the second cup holder shown in FIG. 6, in accordance with one embodiment.
Figure 9:
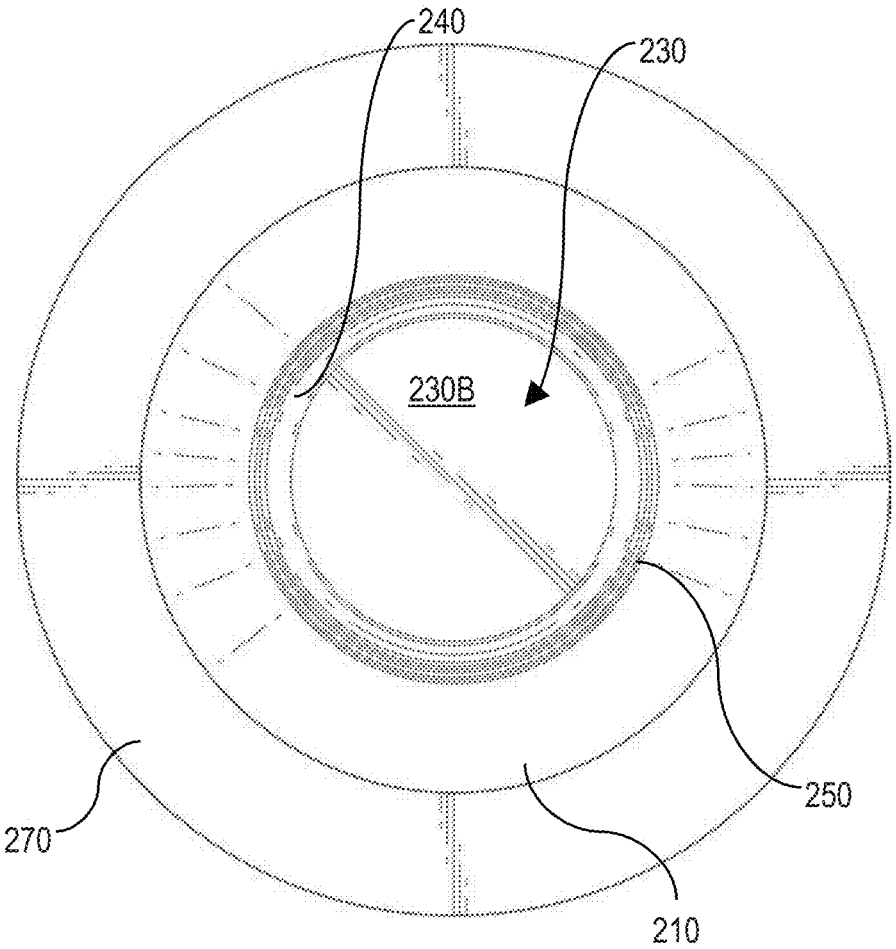
FIG. 9 is a top plan view of the second cup holder shown in FIG. 6, in accordance with one embodiment.
Figure 10:
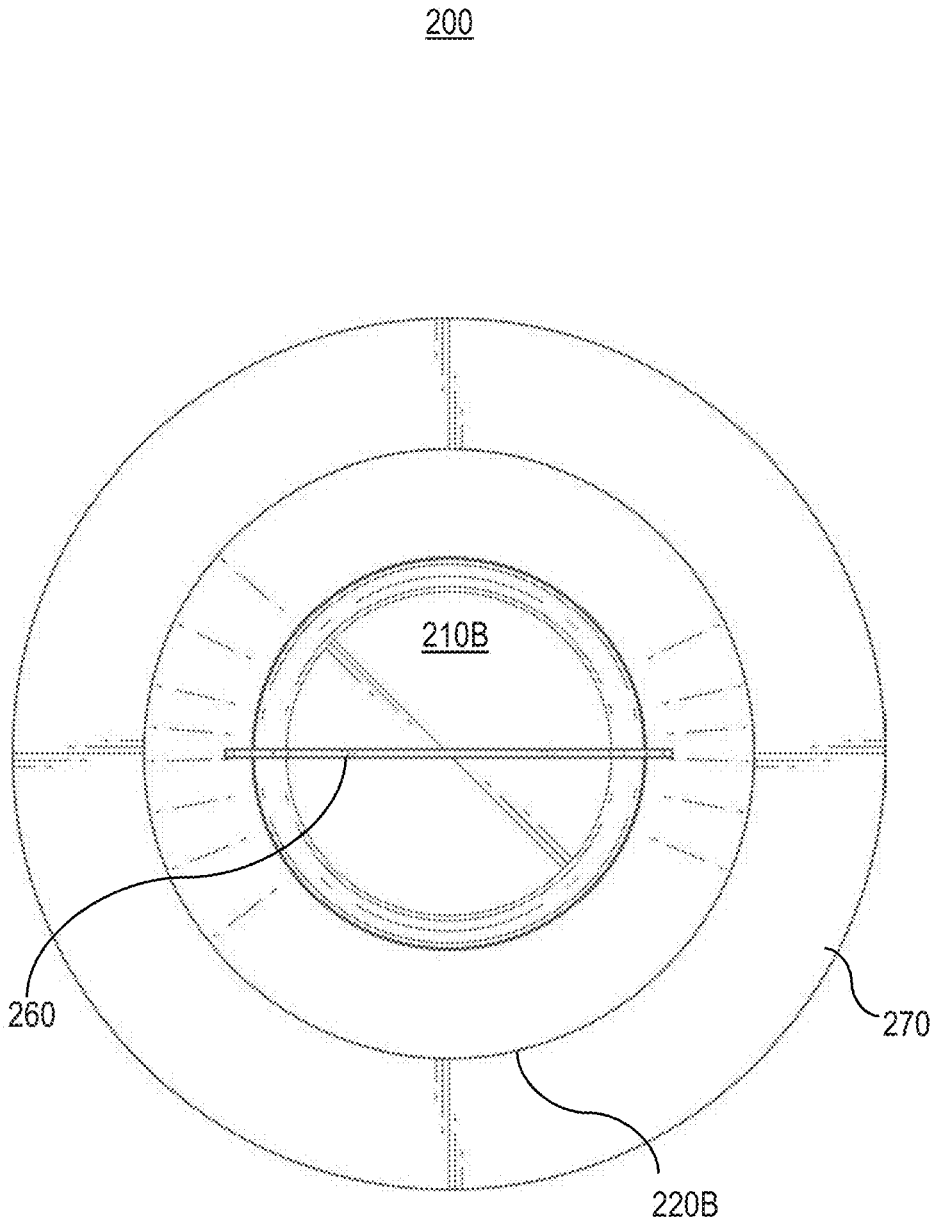
FIG. 10 is a bottom plan view of the second cup holder shown in FIG. 6, in accordance with one embodiment.

FIGS. 6-10 are different views of a cup holder 200, in accordance with one embodiment. FIG. 6 is a perspective view of the cup holder 200, in accordance with one embodiment. FIG. 7 is a side view of the cup holder 200, in accordance with one embodiment. FIG. 8 is another side view of the cup holder 200, in accordance with one embodiment. FIG. 9 is a top plan view of the cup holder 200. FIG. 10 is a bottom plan view of the cup holder 200, in accordance with one embodiment. In one embodiment, the cup holder 200 comprises an upper end 201 and a lower end 202. The upper end 201 comprises a receptacle 210 inside of which a drinking vessel may be removably placed to contain the drinking vessel. The receptable 210 is designed and shaped to receive and contain different sizes and types of drinking vessels.

In one embodiment, the receptacle 210 comprises a hollow recess 230 with an open mouth 230M at a top 210A of the receptacle 210, an interior surrounding sidewall 240 below the open mouth 230M, and a substantially planar (i.e., flat) interior base wall 230B defining a bottom of the hollow recess 230. The interior surrounding sidewall 240 extends vertically between the open mouth 230M and the interior base wall 230B. The interior base wall 230B extends horizontally across the bottom of the hollow recess 230. The hollow recess 230, the interior surrounding sidewall 240, and the interior base wall 230B define an inner portion of the receptacle 210. The interior base wall 230B defines an interior surface of a bottom 210B of the receptacle 210.

The open mouth 230M is designed and shaped to receive a portion of a drinking vessel (e.g., a portion of a drinking vessel that includes a bottom of the drinking vessel). In one embodiment, the open mouth 230M is substantially circular with a diameter that is sized to receive a substantially cylindrical drinking vessel. For example, in one embodiment, the diameter of the open mouth 230M is substantially within a range of about 3 inches to about 4 inches.

The hollow recess 230, the interior surrounding sidewall 240, and the interior base wall 230B are designed and shaped to securely contain a portion of a drinking vessel (e.g., a portion of a drinking vessel that includes a bottom of the drinking vessel). In one embodiment, the interior surrounding sidewall 240 and the hollow recess 230 are substantially cylindrical and the interior base wall 230B is substantially circular, all with a depth (or height) and/or a diameter that is sized to securely contain a substantially cylindrical drinking vessel of various sizes. For example, in one embodiment, the diameter of the interior base wall 230B, the diameter of the interior surrounding sidewall 240, and the diameter of the hollow recess 230 are substantially within a range of about 3 inches to about 4 inches. For example, in one embodiment, the depth (or height) of the interior surrounding sidewall 240 and the depth (or height) of the hollow recess 230 are substantially within a range of about 3 inches to about 3¼ inches. In one embodiment, the interior surrounding sidewall 240 is formed of a single continuous piece or of a plurality of separate pieces.

In one embodiment, the receptacle 210 further comprises a rim 250 defining a periphery of the open mouth 230M, an exterior surrounding sidewall 220 extending downwardly from the rim 250, and a flange 270 extending substantially radially outward from a bottom 220B of the exterior surrounding sidewall 220. As described in detail later herein, the flange 270 is a projecting flat rim, collar, or rib on the receptacle 210 that extends horizontally from the bottom 220B of the exterior surrounding sidewall 220 to provide increased stability. The rim 250, the exterior surrounding sidewall 220, and the flange 270 define an outer portion of the receptacle 210. In one embodiment, a thickness of the rim 250 varies. For example, in one embodiment, the thickness of the rim 250 is substantially within a range of about 2 cm to 3 cm.

In one embodiment, the bottom 220B of the exterior surrounding sidewall 220 and the flange 270 are substantially coplanar with the bottom 210B of the receptacle 210. In another embodiment, the bottom 220B of the exterior surrounding sidewall 220 and the flange 270 extend beyond the bottom 210B of the receptacle 210.

In one embodiment, the exterior surrounding sidewall 220 is substantially cylindrical. A diameter of the exterior surrounding sidewall 220 is larger than the diameter of the interior surrounding sidewall 240 and the hollow recess 230. In one embodiment, a thickness of the exterior surrounding sidewall 220 varies.

In one embodiment, the flange 270 is substantially circular. A diameter of the flange 270 is larger than the diameter of the exterior surrounding sidewall 220 and the diameter of the interior surrounding sidewall 240 and the hollow recess 230. In one embodiment, a thickness of the flange 270 varies.

In one embodiment, the exterior surrounding sidewall 220 is flared, such that the exterior surrounding sidewall 220 outwardly tapers as the exterior surrounding sidewall 220 extends downwardly from the rim 250. The diameter of the exterior surrounding sidewall 220 increases as the exterior surrounding sidewall 220 extends downwardly, i.e., the diameter at a top 220A of the exterior surrounding sidewall 220 is narrower than the diameter at the flared bottom 220B of the exterior surrounding sidewall 220. In one embodiment, the diameter of the exterior surrounding sidewall 220 at the flared bottom 220B varies depending on an amount of stability required (e.g., the diameter is wider if more stability is required). For example, in one embodiment, the diameter of the exterior surrounding sidewall 220 at the flared bottom 220B is substantially within a range of about 4½ inches to about 5½ inches. In one embodiment, the exterior surrounding sidewall 220 is formed of a single continuous piece or of a plurality of separate pieces.

The flange 270 defines the widest part of the receptacle 210 which in turn defines the widest part of the entire cup holder 200. In one embodiment, the diameter of the flange 270 (i.e., the diameter/width of the widest part of the receptacle 210/the entire cup holder 200) varies depending on an amount of stability required (e.g., the diameter is wider if more stability is required). For example, in one embodiment, the diameter of the flange 270 (i.e., the diameter/width of the widest part of the receptacle 210/the entire cup holder 200) is substantially within a range of about 5 inches to about 6½ inches. In one embodiment, the flange 270 is formed of a single continuous piece or of a plurality of separate pieces.

The receptacle 210 is designed and shaped to receive a portion of a drinking vessel (e.g., a bottom half of a drinking vessel) via the open mouth 230M, and securely retain the portion of the drinking vessel inside the receptacle 210 (i.e., inside the inner portion of the receptacle 210). The depth (or height) and/or the diameter of the hollow recess 230, the interior surrounding sidewall 240, and the interior base wall 230B are sized to securely engage and retain the portion of the drinking vessel. The interior surround sidewall 240 maintains the drinking vessel in an upright position and restricts movement of the drinking vessel, thereby preventing the drinking vessel from tipping and in turn reducing or preventing spillage of any liquids contained inside the drinking vessel.

In one embodiment, the lower end 202 comprises a downwardly extending arm 260 extending from the bottom 210B of the receptacle 210. In one embodiment, a top 260A of the downwardly extending arm 260 is attached or connected to a center of an exterior surface of the bottom 210B of the receptacle 210.

In one embodiment, the downwardly extending arm 260 is designed and shaped to be removably inserted (i.e., wedged) in between one or more portions of a seating area, such as a sofa or a couch, to securely retain the cup holder 200 in an upright position. In one embodiment, a thickness of the downwardly extending arm 260 varies based on an amount of gap or space in between the one or more portions of the seating area (e.g., the thickness is thicker if the gap or space is wider). For example, in one embodiment, the downwardly extending arm 260 is designed and shaped to be removably inserted (i.e., wedged) in between a pair of seat cushions or seat pads of a seating area (e.g., sofa or couch cushions of a sofa or couch). As another example, in one embodiment, the downwardly extending arm 260 is designed and shaped to be removably inserted (i.e., wedged) in between an arm rest and a seat cushion or seat pad of a seating area. As yet another example, in one embodiment, the downwardly extending arm 260 is designed and shaped to be removably inserted (i.e., wedged) in between any pair of cushions, pillows, or pads (e.g., floor cushions or pillows positioned on a floor, pillows positioned on a bed, etc.).

To securely retain the cup holder 200 in an upright position, the downwardly extending arm 260 is inserted in between one or more portions of a seating area (e.g., in between sofa cushions of a sofa) until the bottom 210B of the receptacle 210, the flared bottom 220B of the exterior surrounding sidewall 220, and/or and the flange 270 makes direct contact with and rests on top of the one or more portions of the seating area (e.g., rests on top of the sofa cushions). The flared bottom 220B of the exterior surrounding sidewall 220 and the flange 270 together function as a support base for the receptacle 210 to maintain its position on the top of the one or more portions of the seating area. For example, if a portion of a drinking vessel is placed inside the receptable 210, a weight of the drinking vessel causes the flared bottom 220B and the flange 270 to press/push against the top of the one or more portions of the seating area, thereby anchoring the receptacle 210. The diameter of the exterior surrounding sidewall 220 at the flared bottom 220B and the diameter of the flange 270 are wide enough to stabilize the receptacle 210 and prevent the entire receptacle 210 from falling into a gap or space in between the one or more portions of the seating area. In one embodiment, an underside of the bottom 210B, the flared bottom 220B, and/or the flange 270 includes one or more non-abrasive detachable attachment mechanisms, such as gripping pads or strips, to detachably attach the bottom 210B, the flared bottom 220B, and/or the flange 270 to the top of the one or more portions of the seating area. With the flange 270, the cup holder 200 provides more stability than the cup holder 100.

In one embodiment, the height of the entire cup holder 200 (including the receptacle 210 and the downwardly extending arm 260) is sized to securely contain a drinking vessel of various sizes. For example, in one embodiment, the height of the entire cup holder 200 is substantially within a range of about 7 inches to about 7½ inches. For example, in one embodiment, the depth (or height) of the receptacle 210 is substantially within a range of about 3 inches to about 3½ inches.

In one embodiment, the downwardly extending arm 260 is substantially triangular and tapers outwardly as the downwardly extending arm 260 extends downwardly from the center of the bottom 210B of the receptacle 210. A width of the downwardly extending arm 260 increases as the downwardly extending arm 260 extends downwardly, i.e., the width at a top 260A of the downwardly extending arm 260 is narrower than the width at a bottom 260B of the downwardly extending arm 260. A height and a width of the downwardly extending arm 260 are sized to reduce a likelihood of the cup holder 200 becoming dislodged from a seating area when there is movement around one or more portions of the seating area that the downwardly extending arm 260 is inserted in between. For example, in one embodiment, the height of the downwardly extending arm 260 is substantially about 4 inches, the width of the downwardly extending arm 260 at the top 260A is substantially within a range of about 1½ inches to about 2 inches, and the width of the downwardly extending arm 260 at the bottom 260B is substantially 3½ inches.

In one embodiment, the bottom 260B of the downwardly extending arm 260 has rounded corners as a safety feature (instead of sharp corners).

Figure 11:
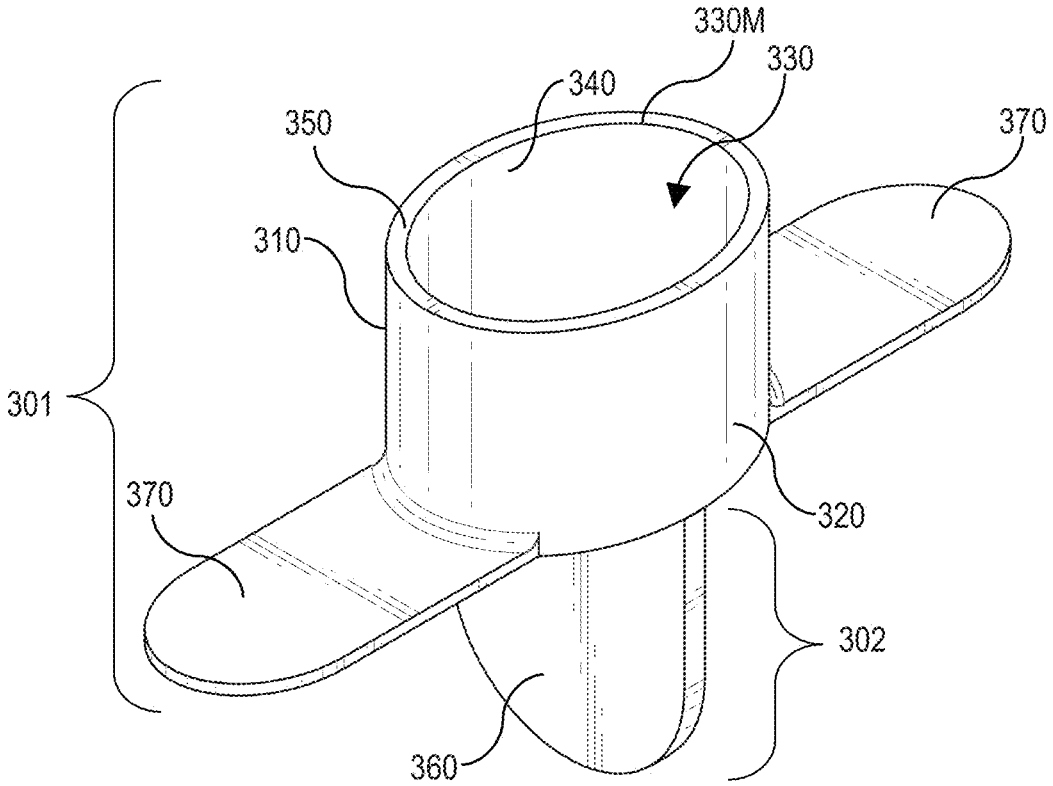
FIG. 11 is a perspective view of a third cup holder, in accordance with one embodiment.
Figure 12:
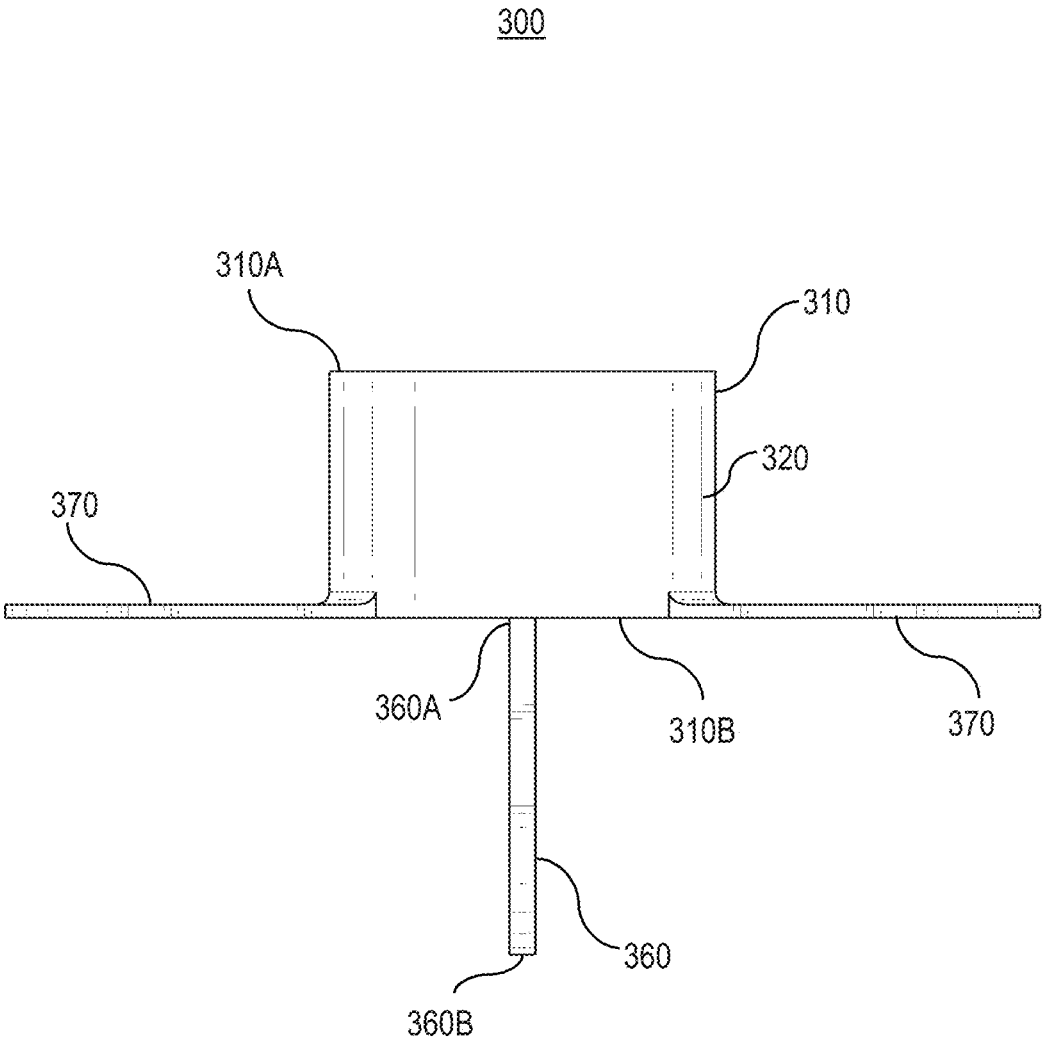
FIG. 12 is a side view of the third cup holder shown in FIG. 11, in accordance with one embodiment.
Figure 13:
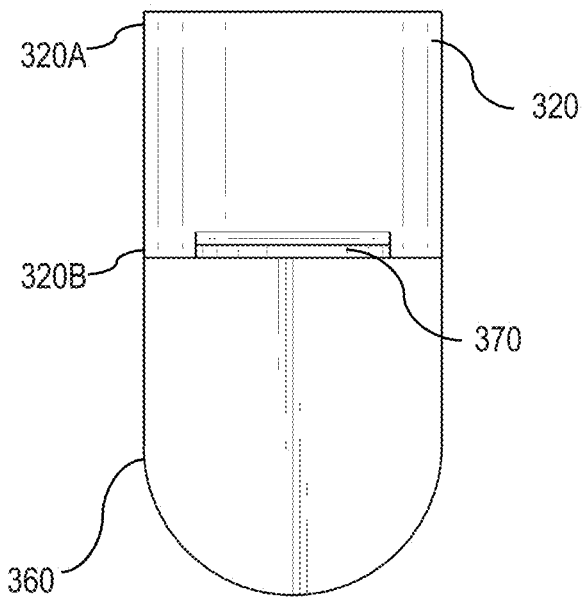
FIG. 13 is another side view of the third cup holder shown in FIG. 11, in accordance with one embodiment.
Figure 14:
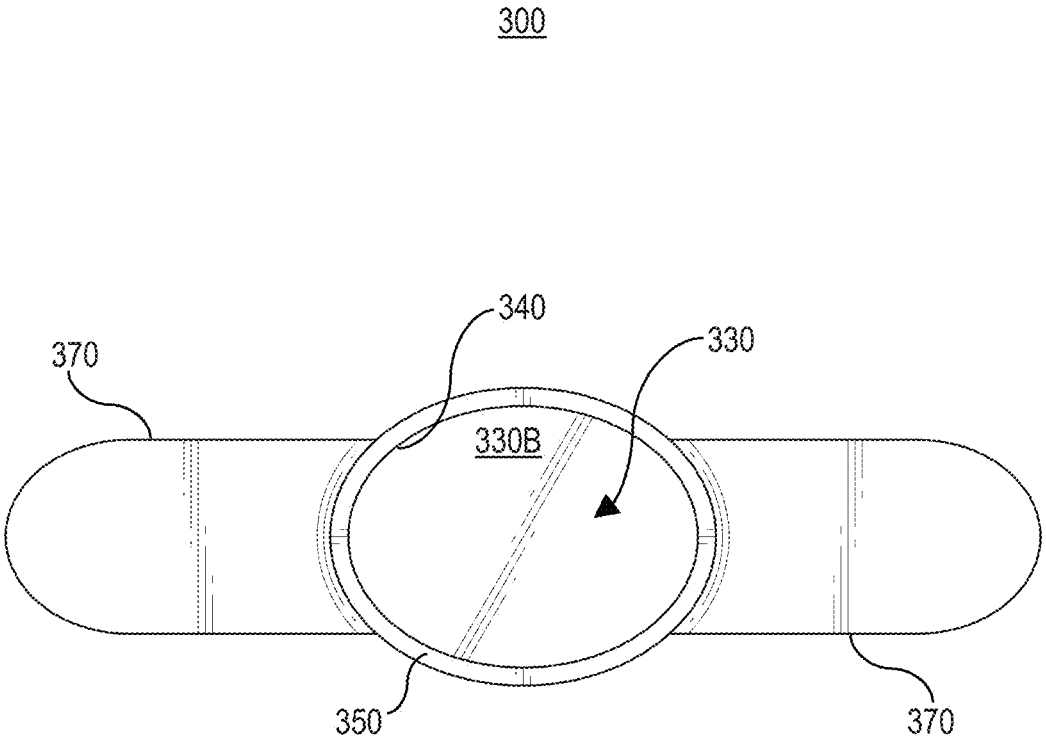
FIG. 14 is a top plan view of the third cup holder shown in FIG. 11, in accordance with one embodiment.
Figure 15:
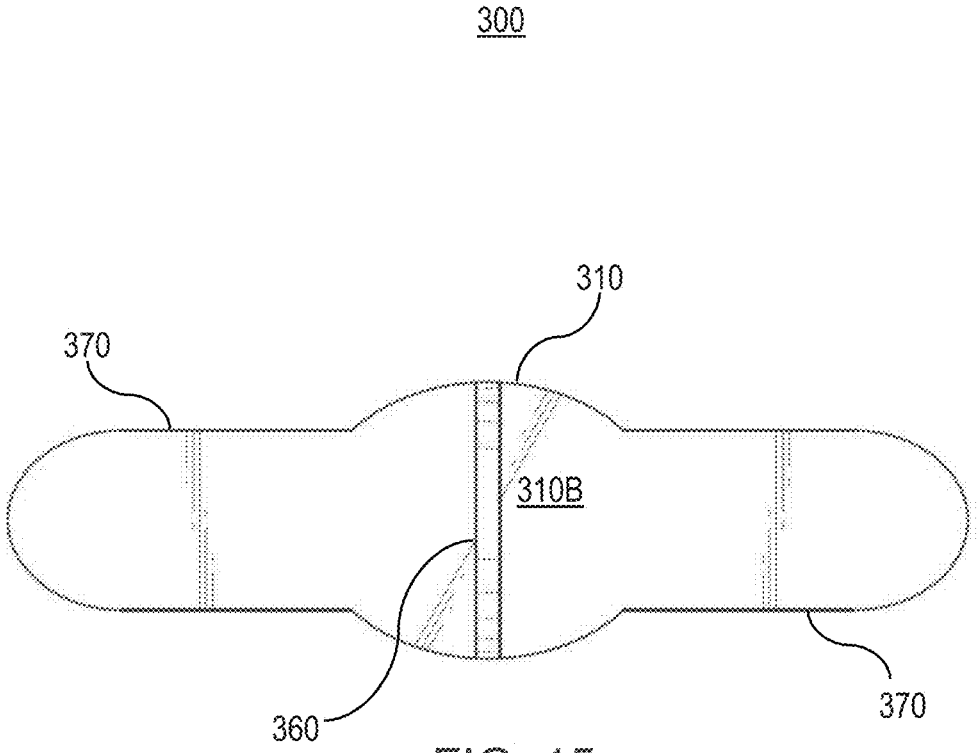
FIG. 15 is a bottom plan view of the third cup holder shown in FIG. 11, in accordance with one embodiment.

FIGS. 11-15 are different views of a cup holder 300, in accordance with one embodiment. FIG. 11 is a perspective view of the cup holder 300, in accordance with one embodiment. FIG. 12 is a side view of the cup holder 300, in accordance with one embodiment. FIG. 13 is another side view of the cup holder 300, in accordance with one embodiment. FIG. 14 is a top plan view of the cup holder 300. FIG. 15 is a bottom plan view of the cup holder 300, in accordance with one embodiment. In one embodiment, the cup holder 300 comprises an upper end 301 and a lower end 302. The upper end 301 comprises a receptacle 310 inside of which a drinking vessel may be removably placed to contain the drinking vessel. The receptable 310 is designed and shaped to receive and contain different sizes and types of drinking vessels.

In one embodiment, the receptacle 310 comprises a hollow recess 330 with an open mouth 330M at a top 310A of the receptacle 310, an interior surrounding sidewall 340 below the open mouth 330M, and a substantially planar (i.e., flat) interior base wall 330B defining a bottom of the hollow recess 330. The interior surrounding sidewall 340 extends vertically between the open mouth 330M and the interior base wall 330B. The interior base wall 330B extends horizontally across the bottom of the hollow recess 330. The hollow recess 330, the interior surrounding sidewall 340, and the interior base wall 330B define an inner portion of the receptacle 310. The interior base wall 330B defines an interior surface of a bottom 310B of the receptacle 310.

The open mouth 330M is designed and shaped to receive a portion of a drinking vessel (e.g., a portion of a drinking vessel that includes a bottom of the drinking vessel). In one embodiment, the open mouth 330M is substantially circular with a diameter that is sized to receive a substantially cylindrical drinking vessel. For example, in one embodiment, the diameter of the open mouth 330M is substantially within a range of about 3 inches to about 4 inches.

The hollow recess 330, the interior surrounding sidewall 340, and the interior base wall 330B are designed and shaped to securely contain a portion of a drinking vessel (e.g., a portion of a drinking vessel that includes a bottom of the drinking vessel). In one embodiment, the interior surrounding sidewall 340 and the hollow recess 330 are substantially cylindrical and the interior base wall 330B is substantially circular, all with a depth (or height) and/or a diameter that is sized to securely contain a substantially cylindrical drinking vessel of various sizes. For example, in one embodiment, the diameter of the interior base wall 330B, the diameter of the interior surrounding sidewall 340, and the diameter of the hollow recess 330 are substantially within a range of about 3 inches to about 4 inches. For example, in one embodiment, the depth (or height) of the interior surrounding sidewall 340 and the depth (or height) of the hollow recess 330 are substantially within a range of about 3 inches to about 3¼ inches. In one embodiment, the interior surrounding sidewall 340 is formed of a single continuous piece or of a plurality of separate pieces.

In one embodiment, the receptacle 310 further comprises a rim 350 defining a periphery of the open mouth 330M, an exterior surrounding sidewall 320 extending downwardly from the rim 350, and one or more fins 370 extending substantially radially outward from a bottom 320B of the exterior surrounding sidewall 320. The one or more fins 370 are spaced apart. For example, in one embodiment, the receptacle 310 includes a pair of opposing fins 370. As described in detail later herein, the one or more fins 370 are extensions that extend horizontally from the bottom 220B of the exterior surrounding sidewall 220 to provide increased stability. The rim 350, the exterior surrounding sidewall 320, and the one or more fins 370 define an outer portion of the receptacle 310. In one embodiment, a thickness of the rim 350 varies. For example, in one embodiment, the thickness of the rim 350 is substantially within a range of about 2 cm to 3 cm.

In one embodiment, the bottom 320B of the exterior surrounding sidewall 320 and the one or more fins 370 are substantially coplanar with the bottom 310B of the receptacle 310. In another embodiment, the bottom 320B of the exterior surrounding sidewall 320 and the one or more fins 370 extend beyond the bottom 310B of the receptacle 310.

In one embodiment, the exterior surrounding sidewall 320 is substantially cylindrical. A diameter of the exterior surrounding sidewall 320 is larger than the diameter of the interior surrounding sidewall 340 and the hollow recess 330. In one embodiment, a thickness of the exterior surrounding sidewall 320 varies.

In one embodiment, each fin 370 is substantially rectangular with rounded ends. In one embodiment, a length, a width, and a thickness of each fin 370 varies depending on an amount of stability required (e.g., the length is longer, the width is wider, and/or the thickness is thicker if more stability is required). For example, in one embodiment, the length of each fin 370 is substantially about 4 inches. The one or more fins 370 define the widest part of the receptacle 310 which in turn defines the widest part of the entire cup holder 300. In one embodiment, the diameter/width of the widest part of the receptacle 310/the entire cup holder 300 varies depending on an amount of stability required (e.g., the diameter is wider if more stability is required).

In one embodiment, the exterior surrounding sidewall 320 is substantially planar as the exterior surrounding sidewall 320 extends downwardly from the rim 350. The exterior surrounding sidewall 320 extends vertically between the rim 350 and the one or more fins 370. In one embodiment, the exterior surrounding sidewall 320 is formed of a single continuous piece or of a plurality of separate pieces.

The receptacle 310 is designed and shaped to receive a portion of a drinking vessel (e.g., a bottom half of a drinking vessel) via the open mouth 330M, and securely retain the portion of the drinking vessel inside the receptacle 310 (i.e., inside the inner portion of the receptacle 310). The depth (or height) and/or the diameter of the hollow recess 330, the interior surrounding sidewall 340, and the interior base wall 330B are sized to securely engage and retain the portion of the drinking vessel. The interior surround sidewall 340 maintains the drinking vessel in an upright position and restricts movement of the drinking vessel, thereby preventing the drinking vessel from tipping and in turn reducing or preventing spillage of any liquids contained inside the drinking vessel.

In one embodiment, the lower end 302 comprises a downwardly extending arm 360 extending from the bottom 310B of the receptacle 310. In one embodiment, a top 360A of the downwardly extending arm 360 is attached or connected to a center of an exterior surface of the bottom 310B of the receptacle 310.

In one embodiment, the downwardly extending arm 360 is designed and shaped to be removably inserted (i.e., wedged) in between one or more portions of a seating area, such as a sofa or a couch, to securely retain the cup holder 300 in an upright position. In one embodiment, a thickness of the downwardly extending arm 360 varies based on an amount of gap or space in between the one or more portions of the seating area (e.g., the thickness is thicker if the gap or space is wider). For example, in one embodiment, the downwardly extending arm 360 is designed and shaped to be removably inserted (i.e., wedged) in between a pair of seat cushions or seat pads of a seating area (e.g., sofa or couch cushions of a sofa or couch). As another example, in one embodiment, the downwardly extending arm 360 is designed and shaped to be removably inserted (i.e., wedged) in between an arm rest and a seat cushion or seat pad of a seating area. As yet another example, in one embodiment, the downwardly extending arm 360 is designed and shaped to be removably inserted (i.e., wedged) in between any pair of cushions, pillows, or pads (e.g., floor cushions or pillows positioned on a floor, pillows positioned on a bed, etc.).

To securely retain the cup holder 300 in an upright position, the downwardly extending arm 360 is inserted in between one or more portions of a seating area (e.g., in between sofa cushions of a sofa) until the bottom 310B of the receptacle 310, the bottom 320B of the exterior surrounding sidewall 320, and/or the one or more fins 370 make direct contact with and rest on top of the one or more portions of the seating area (e.g., rests on top of the sofa cushions). The bottom 320B of the exterior surrounding sidewall 320 and the one or more fins 370 together function as a support base for the receptacle 310 to maintain its position on the top of the one or more portions of the seating area. For example, if a portion of a drinking vessel is placed inside the receptable 310, a weight of the drinking vessel causes the bottom 320B and the one or more fins 370 to press/push against the top of the one or more portions of the seating area, thereby anchoring the receptacle 310. The diameter of the exterior surrounding sidewall 320 at the bottom 320B and the length of each fin 370 are wide enough to stabilize the receptacle 310 and prevent the entire receptacle 310 from falling into a gap or space in between the one or more portions of the seating area. In one embodiment, an underside of the bottom 310B, the bottom 320B, and/or the one or more fins 370 includes one or more non-abrasive detachable attachment mechanisms, such as gripping pads or strips, to detachably attach the bottom 310B, the bottom 320B, and/or the one or more fins 370 to the top of the one or more portions of the seating area. With the one or more fins 370, the cup holder 300 provides more stability than the cup holder 100.

In one embodiment, the height of the entire cup holder 300 (including the receptacle 310 and the downwardly extending arm 360) is sized to securely contain a drinking vessel of various sizes. For example, in one embodiment, the height of the entire cup holder 300 is substantially within a range of about 7 inches to about 7½ inches. For example, in one embodiment, the depth (or height) of the receptacle 310 is substantially within a range of about 3 inches to about 3½ inches.

In one embodiment, the downwardly extending arm 360 is substantially rectangular with rounded ends. A height and a width of the downwardly extending arm 360 are sized to reduce a likelihood of the cup holder 300 becoming dislodged from a seating area when there is movement around one or more portions of the seating area that the downwardly extending arm 360 is inserted in between. For example, in one embodiment, the height of the downwardly extending arm 360 is substantially about 4 inches, the width of the downwardly extending arm 360 at the top 360A is substantially within a range of about 1½ inches to about 2 inches, and the width of the downwardly extending arm 360 at the bottom 360B is substantially about 3½ inches.

In one embodiment, a bottom 360B of the downwardly extending arm 360 includes the rounded ends as a safety feature (instead of sharp corners).

Figure 16:
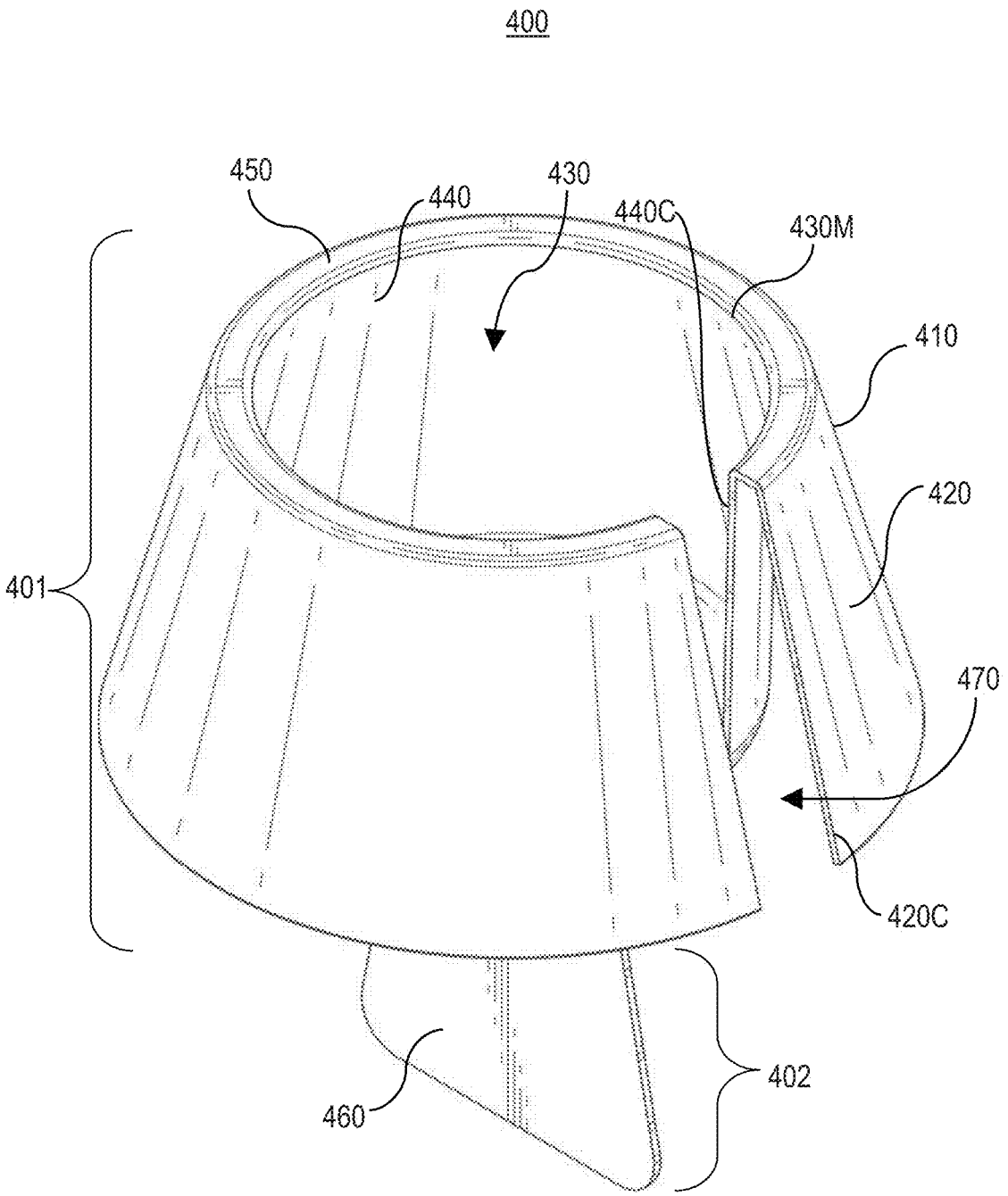
FIG. 16 is a perspective view of a fourth cup holder, in accordance with one embodiment.
Figure 17:
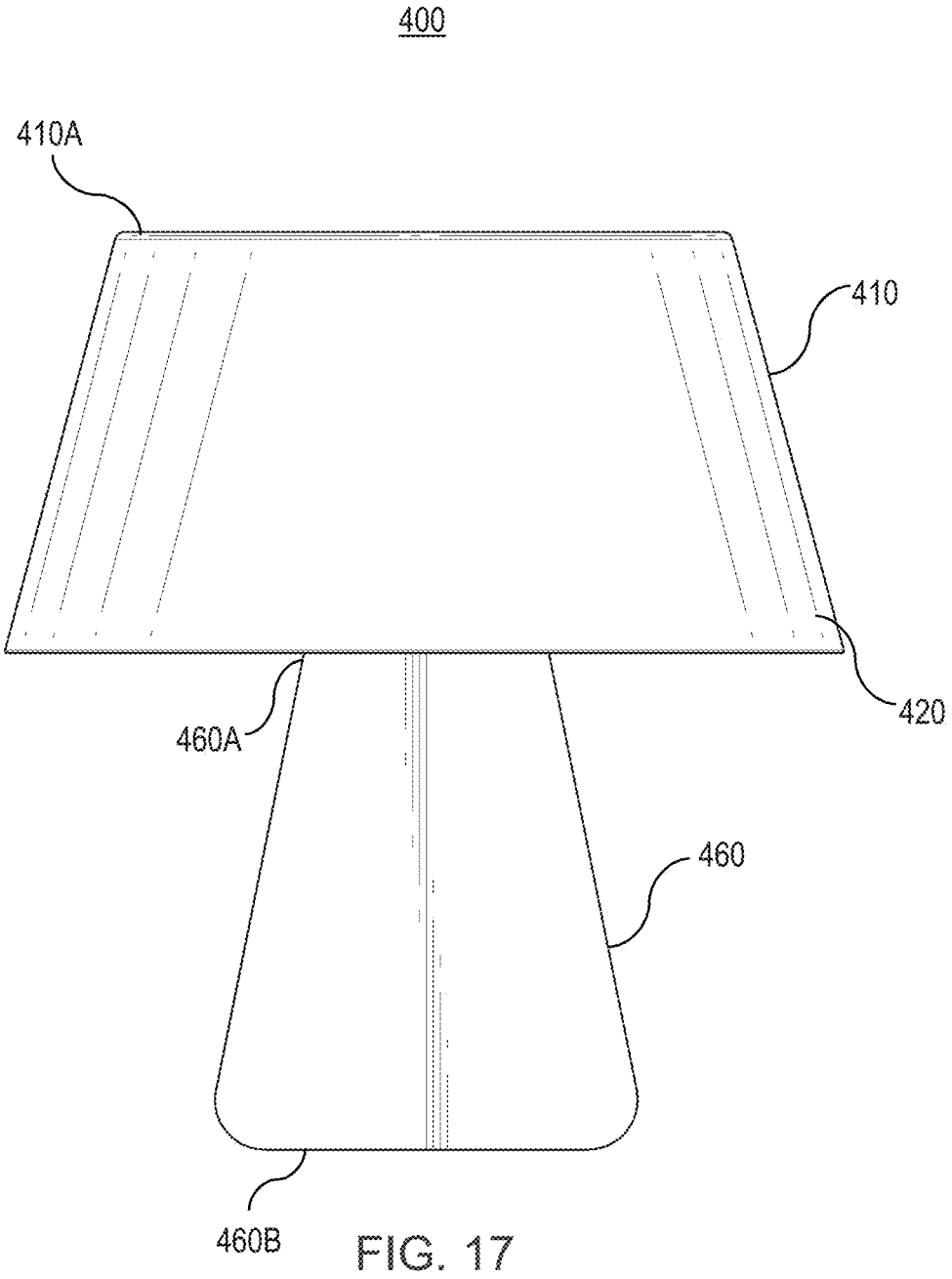
FIG. 17 is a side view of the fourth cup holder shown in FIG. 16, in accordance with one embodiment.
Figure 18:
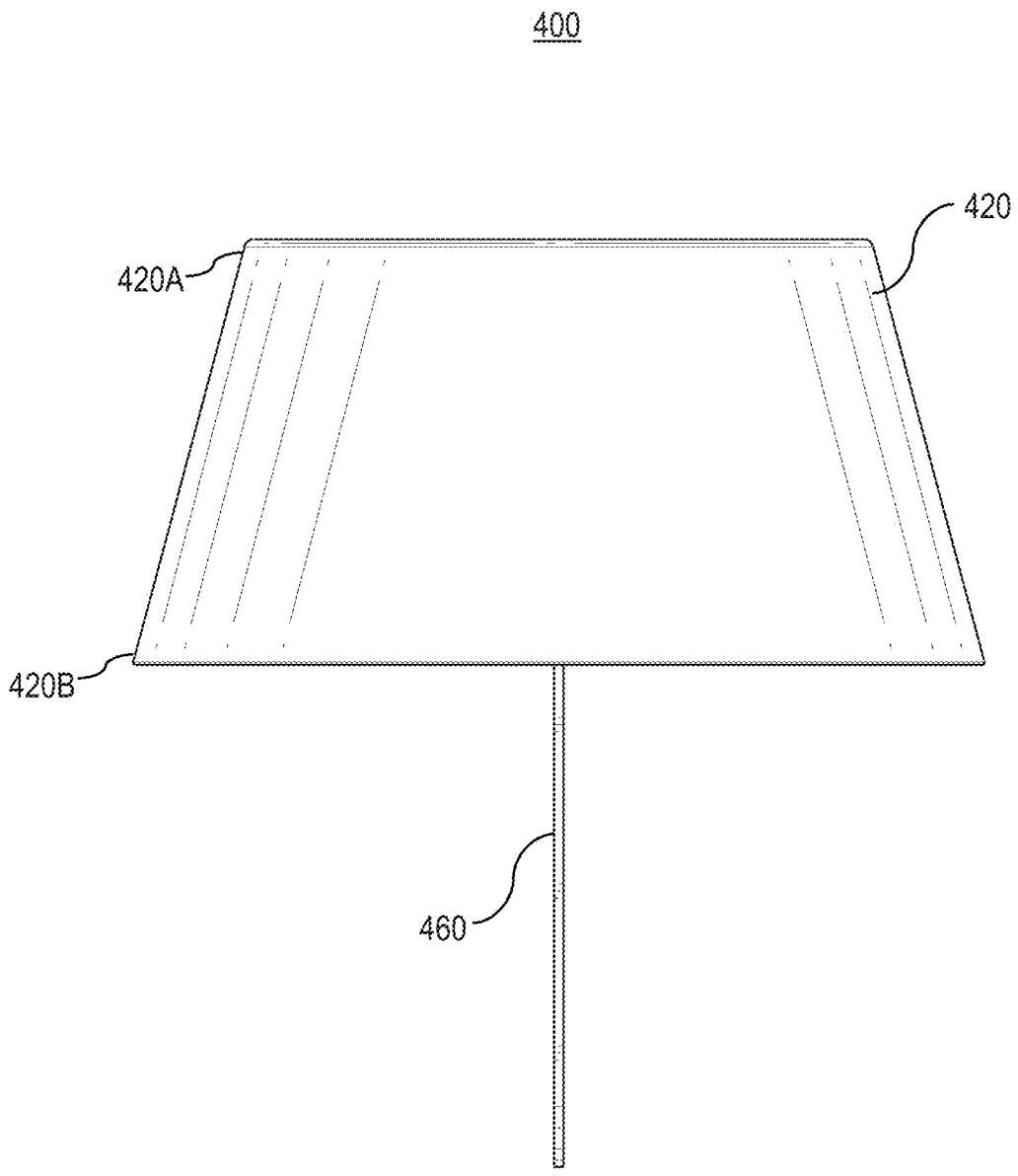
FIG. 18 is another side view of the fourth cup holder shown in FIG. 16, in accordance with one embodiment.
Figure 19:
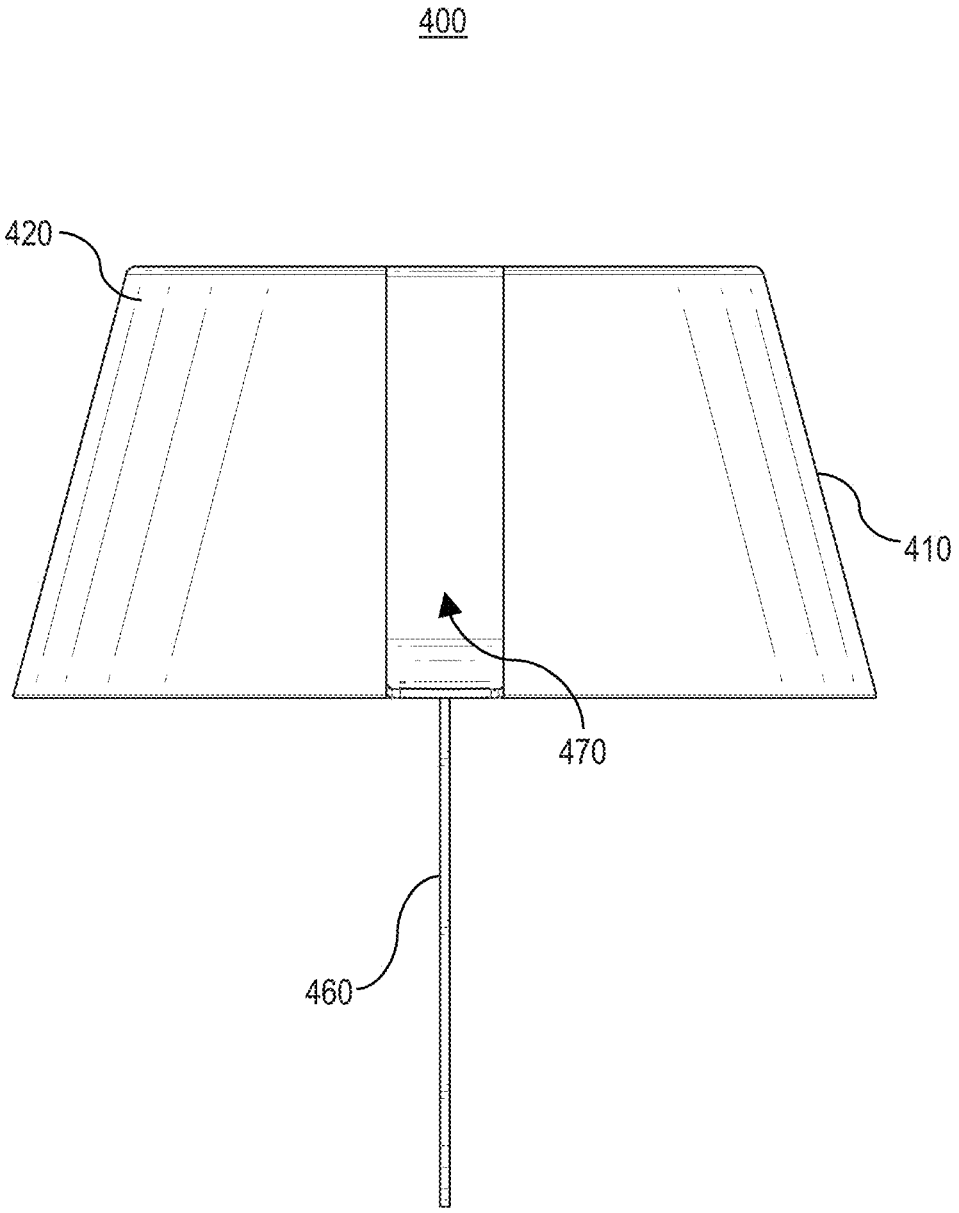
FIG. 19 is yet another side view of the fourth cup holder shown in FIG. 16, in accordance with one embodiment.
Figure 20:
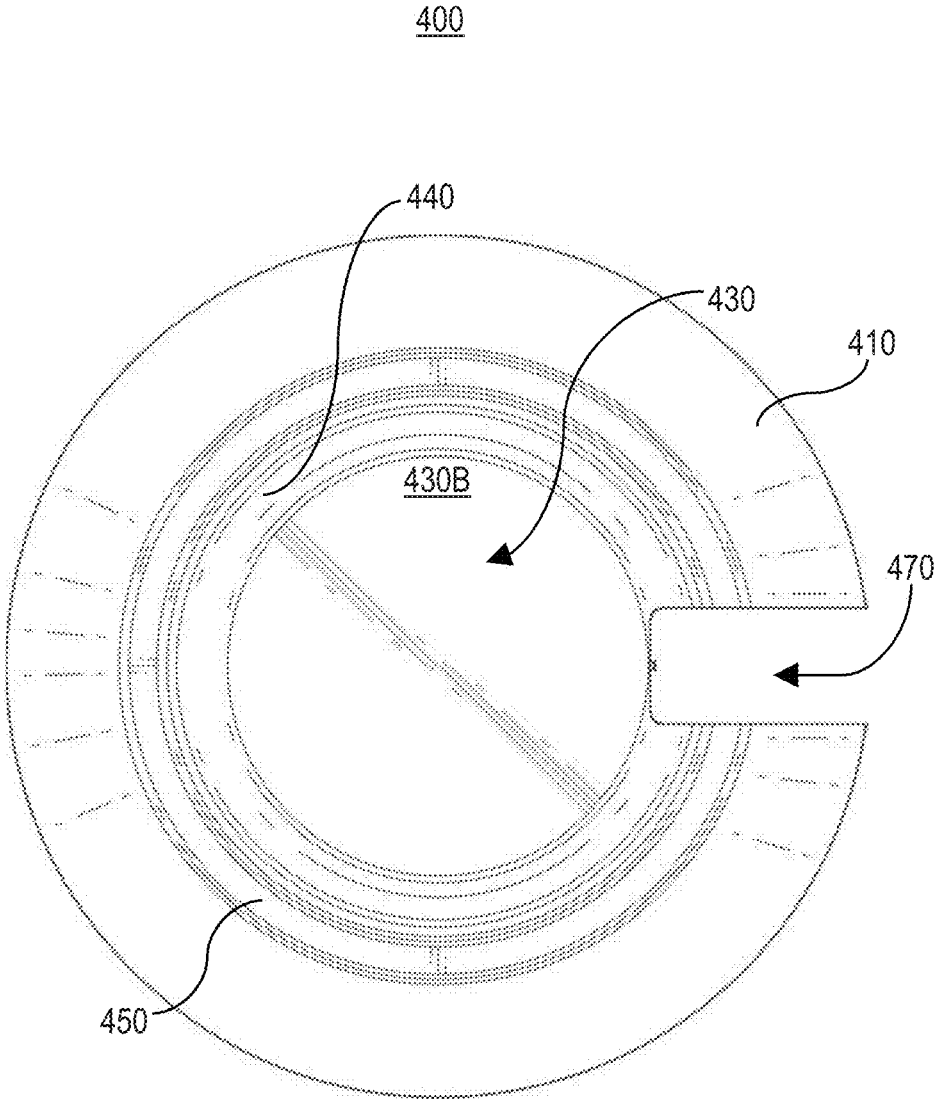
FIG. 20 is a top plan view of the fourth cup holder shown in FIG. 16, in accordance with one embodiment.
Figure 21:
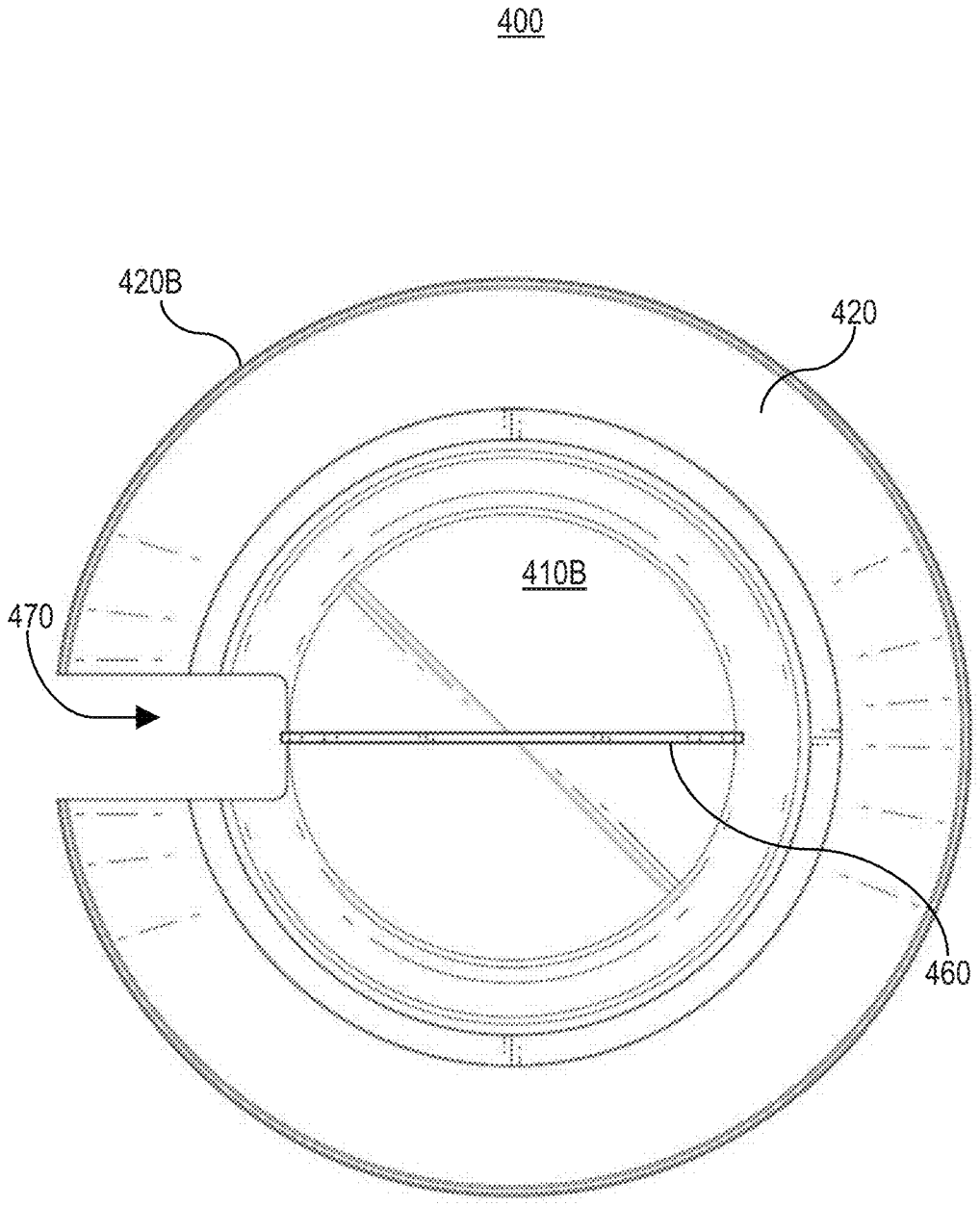
FIG. 21 is a bottom plan view of the fourth cup holder shown in FIG. 16, in accordance with one embodiment.

FIGS. 16-21 are different views of a cup holder 400, in accordance with one embodiment. FIG. 16 is a perspective view of the cup holder 400, in accordance with one embodiment. FIG. 17 is a side view of the cup holder 400, in accordance with one embodiment. FIG. 18 is another side view of the cup holder 400, in accordance with one embodiment. FIG. 19 is yet another side view of the cup holder 400, in accordance with one embodiment. FIG. 20 is a top plan view of the cup holder 400. FIG. 21 is a bottom plan view of the cup holder 400, in accordance with one embodiment. In one embodiment, the cup holder 400 comprises an upper end 401 and a lower end 402. The upper end 401 comprises a receptacle 410 inside of which a drinking vessel may be removably placed to contain the drinking vessel. The receptable 410 is designed and shaped to receive and contain different sizes and types of drinking vessels.

In one embodiment, the receptacle 410 comprises a hollow recess 430 with an open mouth 430M at a top 410A of the receptacle 410, an interior surrounding sidewall 440 below the open mouth 430M, and a substantially planar (i.e., flat) interior base wall 430B defining a bottom of the hollow recess 430. The interior surrounding sidewall 440 extends vertically between the open mouth 430M and the interior base wall 430B. The interior base wall 430B extends horizontally across the bottom of the hollow recess 430. The hollow recess 430, the interior surrounding sidewall 440, and the interior base wall 430B define an inner portion of the receptacle 410. The interior base wall 430B defines an interior surface of a bottom 410B of the receptacle 410.

The open mouth 430M is designed and shaped to receive a portion of a drinking vessel (e.g., a portion of a drinking vessel that includes a bottom of the drinking vessel). In one embodiment, the open mouth 430M is substantially circular with a diameter that is sized to receive a substantially cylindrical drinking vessel. For example, in one embodiment, the diameter of the open mouth 430M is substantially within a range of about 3 inches to about 4 inches.

The hollow recess 430, the interior surrounding sidewall 440, and the interior base wall 430B are designed and shaped to securely contain a portion of a drinking vessel (e.g., a portion of a drinking vessel that includes a bottom of the drinking vessel). In one embodiment, the interior surrounding sidewall 440 and the hollow recess 430 are substantially cylindrical and the interior base wall 430B is substantially circular, all with a depth (or height) and/or a diameter that is sized to securely contain a substantially cylindrical drinking vessel of various sizes. For example, in one embodiment, the diameter of the interior base wall 430B, the diameter of the interior surrounding sidewall 440, and the diameter of the hollow recess 430 are substantially within a range of about 3 inches to about 4 inches. For example, in one embodiment, the depth (or height) of the interior surrounding sidewall 440 and the depth (or height) of the hollow recess 430 are substantially within a range of about 3 inches to about 3¼ inches. In one embodiment, the interior surrounding sidewall 440 is formed of a single continuous piece or of a plurality of separate pieces.

In one embodiment, the receptacle 410 further comprises a rim 450 defining a periphery of the open mouth 430M, and an exterior surrounding sidewall 420 extending downwardly from the rim 450. The rim 450 and the exterior surrounding sidewall 420 define an outer portion of the receptacle 410. In one embodiment, a thickness of the rim 450 varies. For example, in one embodiment, the thickness of the rim 450 is substantially within a range of about 2 cm to 3 cm.

In one embodiment, a bottom 420B of the exterior surrounding sidewall 420 is substantially coplanar with the bottom 410B of the receptacle 410. In another embodiment, the bottom 420B of the exterior surrounding sidewall 420 extends beyond the bottom 410B of the receptacle 410.

In one embodiment, the exterior surrounding sidewall 420 is substantially cylindrical. A diameter of the exterior surrounding sidewall 420 is larger than the diameter of the interior surrounding sidewall 440 and the hollow recess 430. In one embodiment, a thickness of the exterior surrounding sidewall 420 varies.

In one embodiment, the exterior surrounding sidewall 420 is flared, such that the exterior surrounding sidewall 420 outwardly tapers as the exterior surrounding sidewall 420 extends downwardly from the rim 450. The diameter of the exterior surrounding sidewall 420 increases as the exterior surrounding sidewall 420 extends downwardly, i.e., the diameter at a top 420A of the exterior surrounding sidewall 420 is narrower than the diameter at the flared bottom 420B of the exterior surrounding sidewall 420. The flared bottom 420B defines the widest part of the receptacle 410 which in turn defines the widest part of the entire cup holder 400. In one embodiment, the diameter of the exterior surrounding sidewall 420 at the flared bottom 420B (i.e., the diameter/width of the widest part of the receptacle 410/the entire cup holder 400) varies depending on an amount of stability required (e.g., the diameter is wider if more stability is required). For example, in one embodiment, the diameter of the exterior surrounding sidewall 420 at the flared bottom 420B (i.e., the diameter/width of the widest part of the receptacle 410/the entire cup holder 400) is substantially within a range of about 4½ inches to about 5½ inches. In one embodiment, the exterior surrounding sidewall 420 is formed of a single continuous piece or of a plurality of separate pieces.

In one embodiment, the interior surrounding sidewall 440 and the exterior surrounding sidewall 420 contain a cut out 440C and a cut out 420C, respectively. The cut out 440C extends vertically along the interior surrounding sidewall 440, starting at the top 410A of the receptacle 410 and terminating at the bottom 410B of the receptacle 410. The cut out 440C extends vertically along the exterior surrounding sidewall 420, starting at the top 420A of the exterior surrounding sidewall 420 and terminating at the bottom 420B of the exterior surrounding sidewall 420. The cut outs 440C and 420C are physically aligned to define a side cut out 470 configured to receive a handle of a drinking vessel (e.g., a handle of a cup or mug). In one embodiment, a width of the cut outs 440C and 420C, and in turn the side cut out 470, varies. For example, in one embodiment, the width of the side cut out 470 is substantially about 1 inch.

The receptacle 410 is designed and shaped to receive a portion of a drinking vessel (e.g., a bottom half of a drinking vessel) via the open mouth 430M, and securely retain the portion of the drinking vessel inside the receptacle 410 (i.e., inside the inner portion of the receptacle 410). If the drinking vessel has a handle, the drinking vessel is placed inside the receptacle 410 such that the handle slots into the side cut out 470. The depth (or height) and/or the diameter of the hollow recess 430, the interior surrounding sidewall 440, and the interior base wall 430B are sized to securely engage and retain the portion of the drinking vessel. The width of the cutouts 440C and 420C are sized to securely engage and retain the handle of the drinking vessel. The interior surround sidewall 440 and the side cut out 470 maintain the drinking vessel in an upright position and restrict movement of the drinking vessel, thereby preventing the drinking vessel from tipping and in turn reducing or preventing spillage of any liquids contained inside the drinking vessel.

In one embodiment, the lower end 402 comprises a downwardly extending arm 460 extending from the bottom 410B of the receptacle 410. In one embodiment, a top 460A of the downwardly extending arm 460 is attached or connected to a center of an exterior surface of the bottom 410B of the receptacle 410.

In one embodiment, the downwardly extending arm 460 is designed and shaped to be removably inserted (i.e., wedged) in between one or more portions of a seating area, such as a sofa or a couch, to securely retain the cup holder 400 in an upright position. In one embodiment, a thickness of the downwardly extending arm 460 varies based on an amount of gap or space in between the one or more portions of the seating area (e.g., the thickness is thicker if the gap or space is wider). For example, in one embodiment, the downwardly extending arm 460 is designed and shaped to be removably inserted (i.e., wedged) in between a pair of seat cushions or seat pads of a seating area (e.g., sofa or couch cushions of a sofa or couch). As another example, in one embodiment, the downwardly extending arm 460 is designed and shaped to be removably inserted (i.e., wedged) in between an arm rest and a seat cushion or seat pad of a seating area. As yet another example, in one embodiment, the downwardly extending arm 460 is designed and shaped to be removably inserted (i.e., wedged) in between any pair of cushions, pillows, or pads (e.g., floor cushions or pillows positioned on a floor, pillows positioned on a bed, etc.).

To securely retain the cup holder 400 in an upright position, the downwardly extending arm 460 is inserted in between one or more portions of a seating area (e.g., in between sofa cushions of a sofa) until the bottom 410B of the receptacle 410 and/or the flared bottom 420B of the exterior surrounding sidewall 420 makes direct contact with and rests on top of the one or more portions of the seating area (e.g., rests on top of the sofa cushions). The flared bottom 420B of the exterior surrounding sidewall 420 functions as a support base for the receptacle 410 to maintain its position on the top of the one or more portions of the seating area. For example, if a portion of a drinking vessel is placed inside the receptable 410, a weight of the drinking vessel causes the flared bottom 420B to press/push against the top of the one or more portions of the seating area, thereby anchoring the receptacle 410. The diameter of the exterior surrounding sidewall 420 at the flared bottom 420B is wide enough to stabilize the receptacle 410 and prevent the entire receptacle 410 from falling into a gap or space in between the one or more portions of the seating area. In one embodiment, an underside of the bottom 410B and/or the flared bottom 420B includes one or more non-abrasive detachable attachment mechanisms, such as gripping pads or strips, to detachably attach the bottom 410B and/or the flared bottom 420B to the top of the one or more portions of the seating area.

In one embodiment, the height of the entire cup holder 400 (including the receptacle 410 and the downwardly extending arm 460) is sized to securely contain a drinking vessel of various sizes. For example, in one embodiment, the height of the entire cup holder 400 is substantially within a range of about 7 inches to about 7½ inches. For example, in one embodiment, the depth (or height) of the receptacle 410 is substantially within a range of about 3 inches to about 3½ inches.

In one embodiment, the downwardly extending arm 460 is substantially triangular and tapers outwardly as the downwardly extending arm 460 extends downwardly from the center of the bottom 410B of the receptacle 410. A width of the downwardly extending arm 460 increases as the downwardly extending arm 460 extends downwardly, i.e., the width at a top 460A of the downwardly extending arm 460 is narrower than the width at a bottom 460B of the downwardly extending arm 460. A height and a width of the downwardly extending arm 460 are sized to reduce a likelihood of the cup holder 400 becoming dislodged from a seating area when there is movement around one or more portions of the seating area that the downwardly extending arm 460 is inserted in between. For example, in one embodiment, the height of the downwardly extending arm 460 is substantially about 4 inches, the width of the downwardly extending arm 460 at the top 460A is substantially within a range of about 1½ inches to about 2 inches, and the width of the downwardly extending arm 460 at the bottom 460B is substantially about 3½ inches.

In one embodiment, the bottom 460B of the downwardly extending arm 460 has rounded corners as a safety feature (instead of sharp corners).

Figure 22:
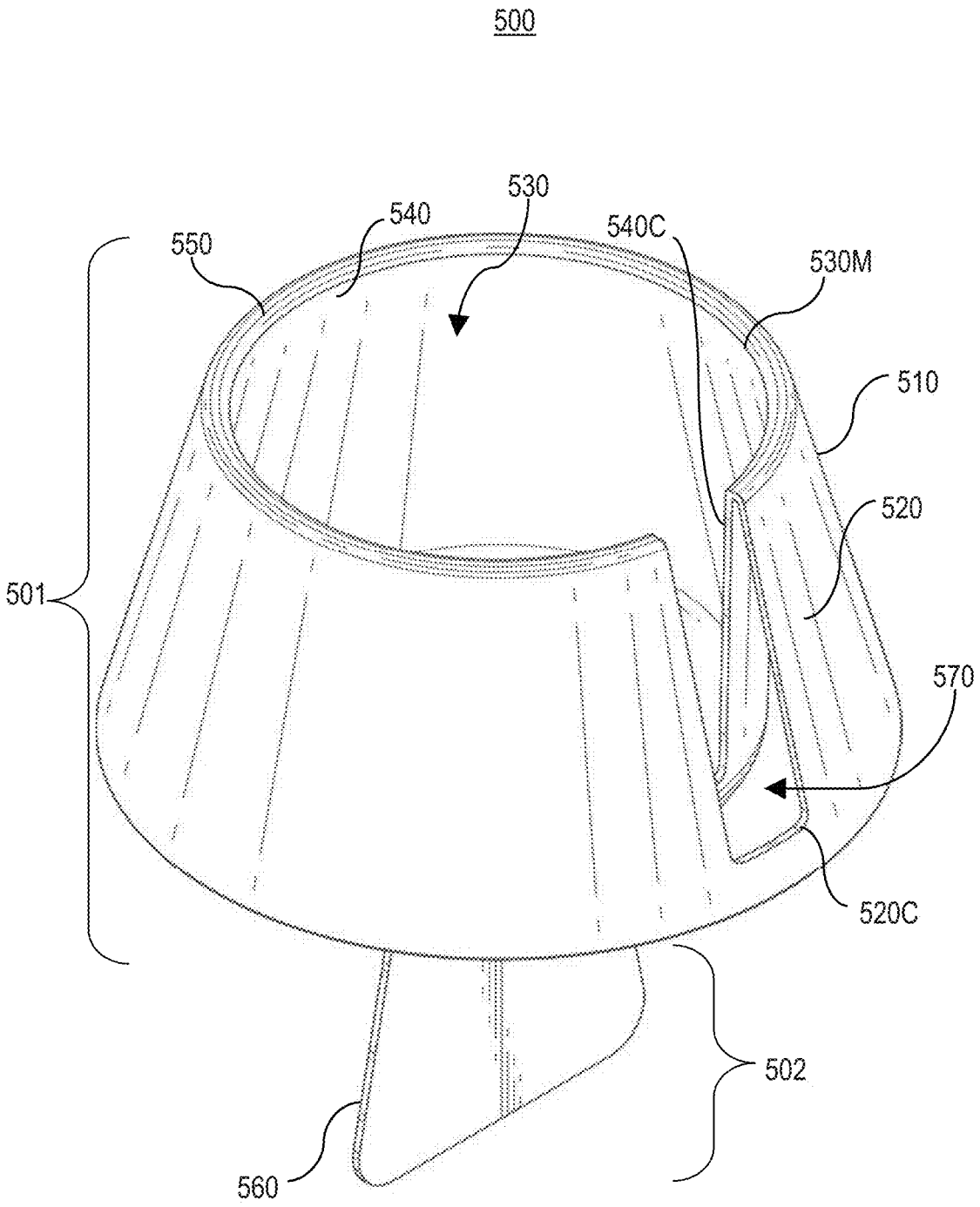
FIG. 22 is a perspective view of a fifth cup holder, in accordance with one embodiment.
Figure 23:
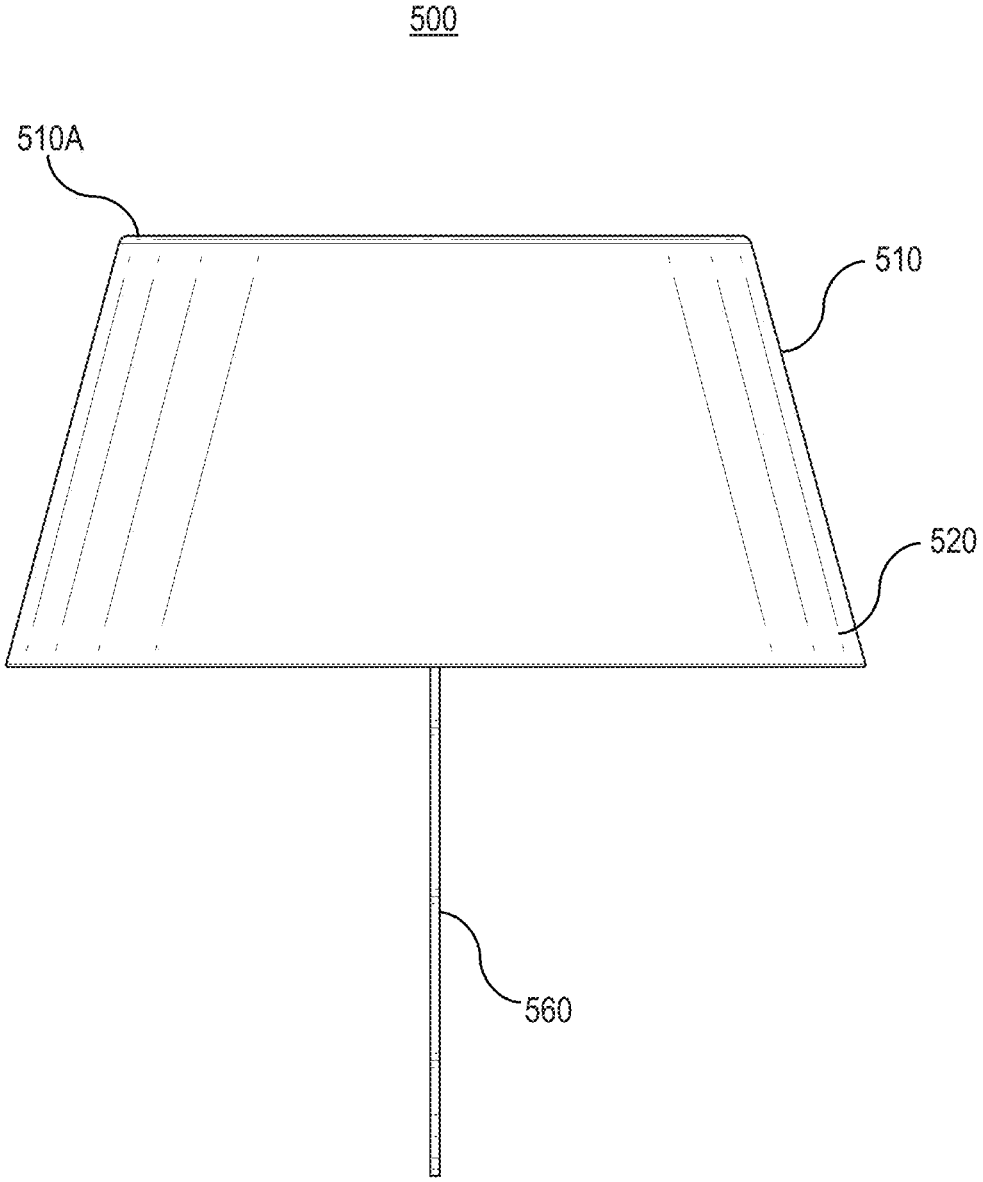
FIG. 23 is a side view of the fifth cup holder shown in FIG. 22, in accordance with one embodiment.
Figure 24:
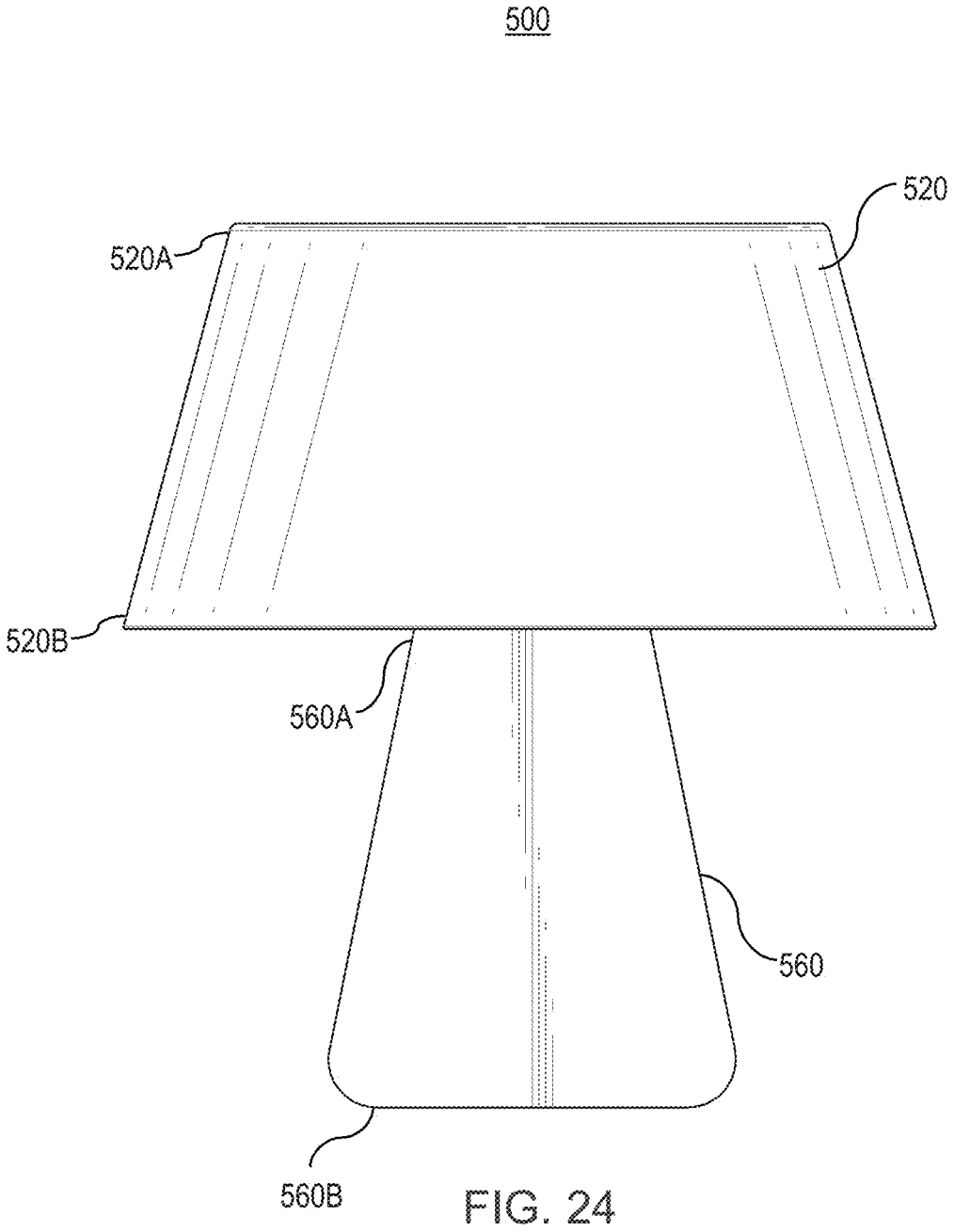
FIG. 24 is another side view of the fifth cup holder shown in FIG. 22, in accordance with one embodiment.
Figure 25:
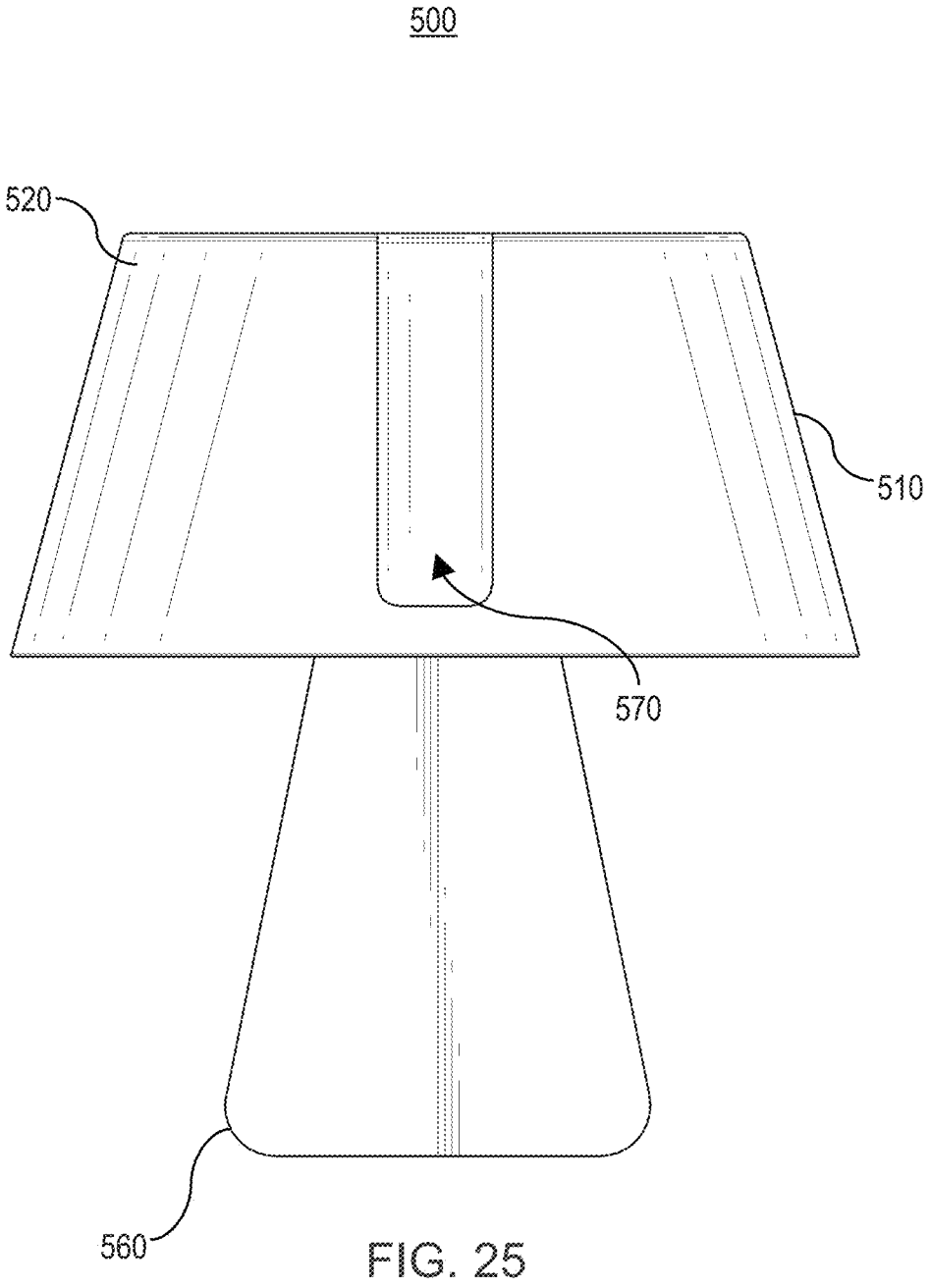
FIG. 25 is yet another side view of the fifth cup holder shown in FIG. 22, in accordance with one embodiment.
Figure 26:
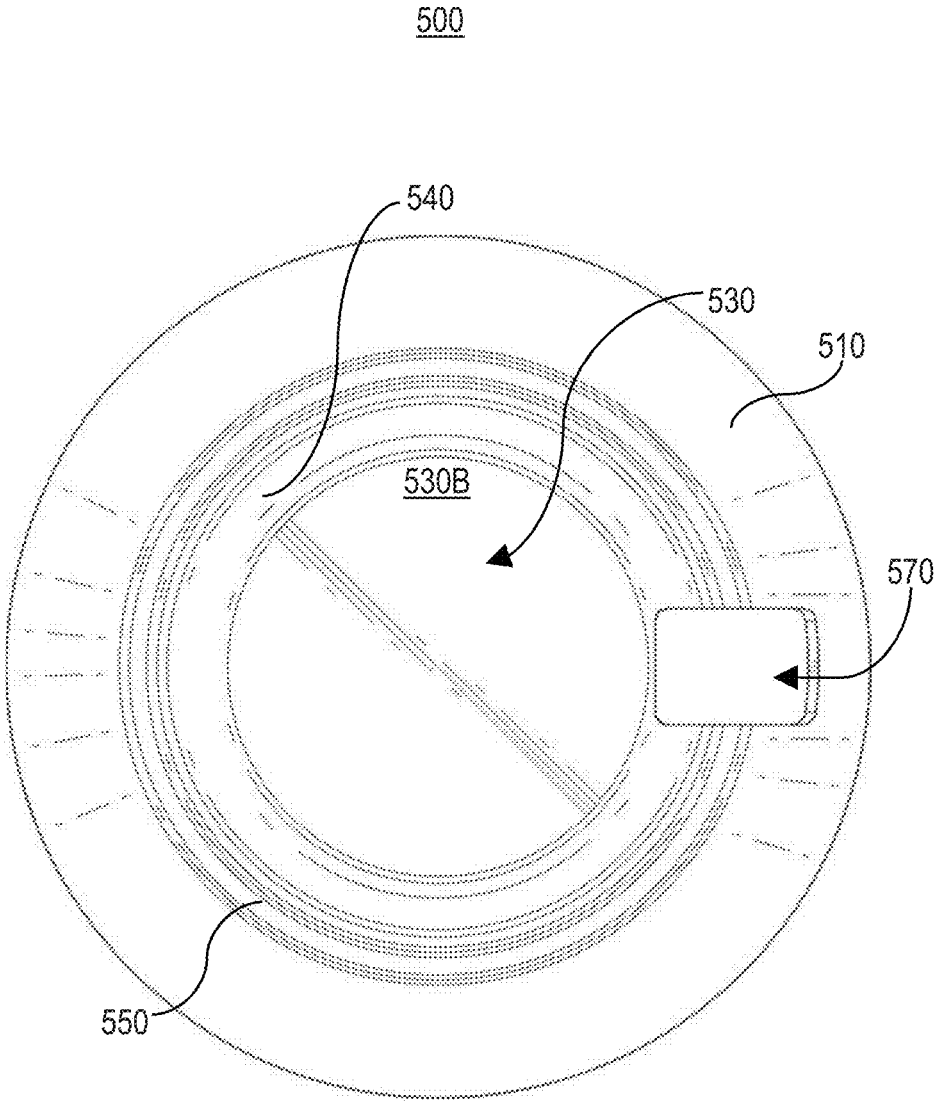
FIG. 26 is a top plan view of the fifth cup holder shown in FIG. 22, in accordance with one embodiment.
Figure 27:
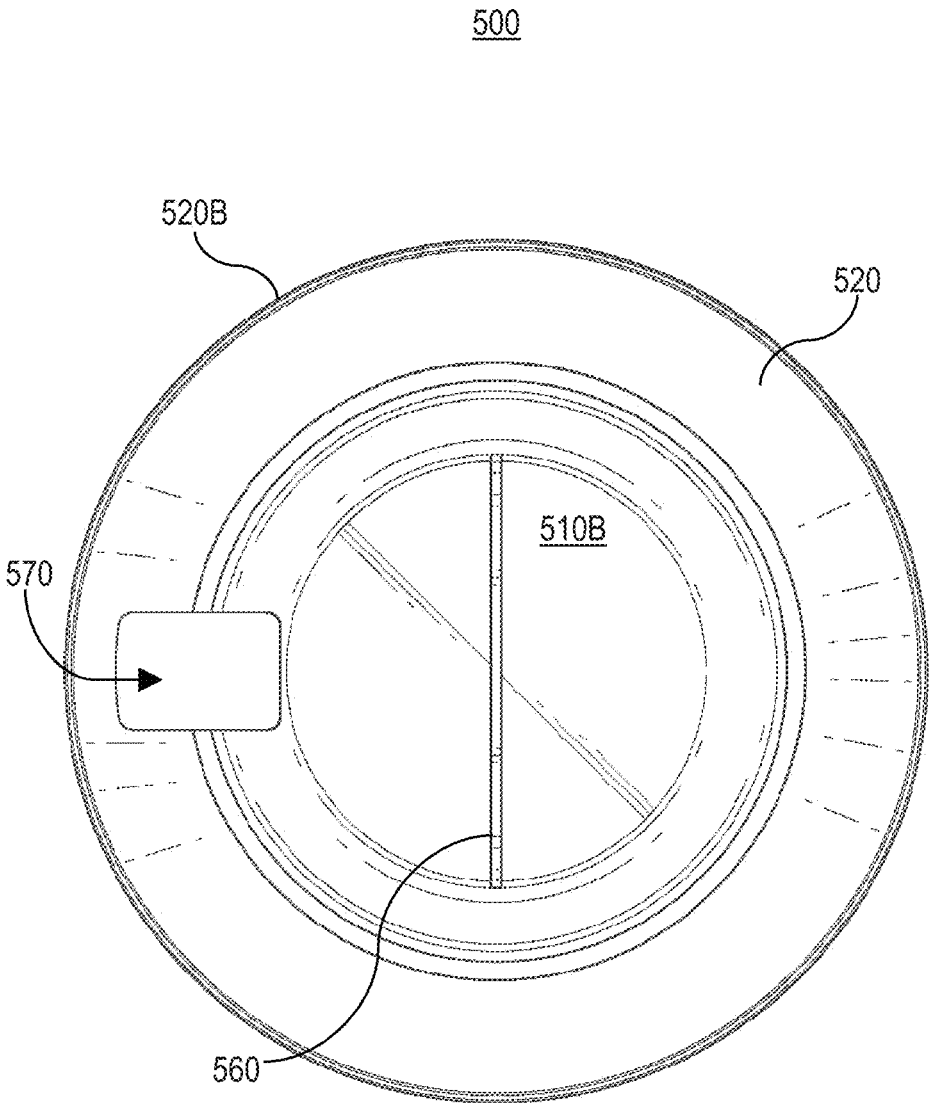
FIG. 27 is a bottom plan view of the fifth cup holder shown in FIG. 22, in accordance with one embodiment.

FIGS. 22-27 are different views of a cup holder 500, in accordance with one embodiment. FIG. 22 is a perspective view of the cup holder 500, in accordance with one embodiment. FIG. 23 is a side view of the cup holder 500, in accordance with one embodiment. FIG. 24 is another side view of the cup holder 500, in accordance with one embodiment. FIG. 25 is yet another side view of the cup holder 500, in accordance with one embodiment. FIG. 26 is a top plan view of the cup holder 500. FIG. 27 is a bottom plan view of the cup holder 500, in accordance with one embodiment. In one embodiment, the cup holder 500 comprises an upper end 501 and a lower end 502. The upper end 501 comprises a receptacle 510 inside of which a drinking vessel may be removably placed to contain the drinking vessel. The receptable 510 is designed and shaped to receive and contain different sizes and types of drinking vessels.

In one embodiment, the receptacle 510 comprises a hollow recess 530 with an open mouth 530M at a top 510A of the receptacle 510, an interior surrounding sidewall 540 below the open mouth 530M, and a substantially planar (i.e., flat) interior base wall 530B defining a bottom of the hollow recess 530. The interior surrounding sidewall 540 extends vertically between the open mouth 530M and the interior base wall 530B. The interior base wall 530B extends horizontally across the bottom of the hollow recess 530. The hollow recess 530, the interior surrounding sidewall 540, and the interior base wall 530B define an inner portion of the receptacle 510. The interior base wall 530B defines an interior surface of a bottom 510B of the receptacle 510.

The open mouth 530M is designed and shaped to receive a portion of a drinking vessel (e.g., a portion of a drinking vessel that includes a bottom of the drinking vessel). In one embodiment, the open mouth 530M is substantially circular with a diameter that is sized to receive a substantially cylindrical drinking vessel. For example, in one embodiment, the diameter of the open mouth 530M is substantially within a range of about 3 inches to about 4 inches.

The hollow recess 530, the interior surrounding sidewall 540, and the interior base wall 530B are designed and shaped to securely contain a portion of a drinking vessel (e.g., a portion of a drinking vessel that includes a bottom of the drinking vessel). In one embodiment, the interior surrounding sidewall 540 and the hollow recess 530 are substantially cylindrical and the interior base wall 530B is substantially circular, all with a depth (or height) and/or a diameter that is sized to securely contain a substantially cylindrical drinking vessel of various sizes. For example, in one embodiment, the diameter of the interior base wall 530B, the diameter of the interior surrounding sidewall 540, and the diameter of the hollow recess 530 are substantially within a range of about 3 inches to about 4 inches. For example, in one embodiment, the depth (or height) of the interior surrounding sidewall 540 and the depth (or height) of the hollow recess 530 are substantially within a range of about 3 inches to about 3¼ inches. In one embodiment, the interior surrounding sidewall 540 is formed of a single continuous piece or of a plurality of separate pieces.

In one embodiment, the receptacle 510 further comprises a rim 550 defining a periphery of the open mouth 530M, and an exterior surrounding sidewall 520 extending downwardly from the rim 550. The rim 550 and the exterior surrounding sidewall 520 define an outer portion of the receptacle 510. In one embodiment, a thickness of the rim 550 varies. For example, in one embodiment, the thickness of the rim 550 is substantially within a range of about 2 cm to 3 cm.

In one embodiment, a bottom 520B of the exterior surrounding sidewall 520 is substantially coplanar with the bottom 510B of the receptacle 510. In another embodiment, the bottom 520B of the exterior surrounding sidewall 520 extends beyond the bottom 510B of the receptacle 510.

In one embodiment, the exterior surrounding sidewall 520 is substantially cylindrical. A diameter of the exterior surrounding sidewall 520 is larger than the diameter of the interior surrounding sidewall 540 and the hollow recess 530. In one embodiment, a thickness of the exterior surrounding sidewall 520 varies.

In one embodiment, the exterior surrounding sidewall 520 is flared, such that the exterior surrounding sidewall 520 outwardly tapers as the exterior surrounding sidewall 520 extends downwardly from the rim 550. The diameter of the exterior surrounding sidewall 520 increases as the exterior surrounding sidewall 520 extends downwardly, i.e., the diameter at a top 520A of the exterior surrounding sidewall 520 is narrower than the diameter at the flared bottom 520B of the exterior surrounding sidewall 520. The flared bottom 520B defines the widest part of the receptacle 510 which in turn defines the widest part of the entire cup holder 500. In one embodiment, the diameter of the exterior surrounding sidewall 520 at the flared bottom 520B (i.e., the diameter/width of the widest part of the receptacle 510/the entire cup holder 500) varies depending on an amount of stability required (e.g., the diameter is wider if more stability is required). For example, in one embodiment, the diameter of the exterior surrounding sidewall 520 at the flared bottom 520B (i.e., the diameter/width of the widest part of the receptacle 510/the entire cup holder 500) is substantially within a range of about 4½ inches to about 5½ inches. In one embodiment, the exterior surrounding sidewall 520 is formed of a single continuous piece or of a plurality of separate pieces.

In one embodiment, the interior surrounding sidewall 540 and the exterior surrounding sidewall 520 contain a cut out 540C and a cut out 520C, respectively. The cut out 540C extends vertically along the interior surrounding sidewall 540, starting at the top 510A of the receptacle 510 and terminating at a point within proximity of the bottom 510B of the receptacle 510 (the cut out 540C does not extend all the way to the bottom 510B). The cut out 540C extends vertically along the exterior surrounding sidewall 520, starting at the top 520A of the exterior surrounding sidewall 520 and terminating at a point within proximity of the bottom 520B of the exterior surrounding sidewall 520 (the cut out 520C does not extend all the way to the bottom 520B). The cut outs 540C and 520C are physically aligned to define a side cut out 570 configured to receive a handle of a drinking vessel (e.g., a handle of a cup or mug). In one embodiment, a width of the cut outs 540C and 520C, and in turn the side cut out 570, varies. For example, in one embodiment, the width of the side cut out 570 is substantially about 1 inch.

The receptacle 510 is designed and shaped to receive a portion of a drinking vessel (e.g., a bottom half of a drinking vessel) via the open mouth 530M, and securely retain the portion of the drinking vessel inside the receptacle 510 (i.e., inside the inner portion of the receptacle 510). If the drinking vessel has a handle, the drinking vessel is placed inside the receptacle 510 such that the handle slots into the side cut out 570. The depth (or height) and/or the diameter of the hollow recess 530, the interior surrounding sidewall 540, and the interior base wall 530B are sized to securely engage and retain the portion of the drinking vessel. The width of the cutouts 540C and 520C are sized to securely engage and retain the handle of the drinking vessel. The interior surround sidewall 540 and the side cut out 570 maintain the drinking vessel in an upright position and restrict movement of the drinking vessel, thereby preventing the drinking vessel from tipping and in turn reducing or preventing spillage of any liquids contained inside the drinking vessel.

In one embodiment, the lower end 502 comprises a downwardly extending arm 560 extending from the bottom 510B of the receptacle 510. In one embodiment, a top 560A of the downwardly extending arm 560 is attached or connected to a center of an exterior surface of the bottom 510B of the receptacle 510.

In one embodiment, the downwardly extending arm 560 is designed and shaped to be removably inserted (i.e., wedged) in between one or more portions of a seating area, such as a sofa or a couch, to securely retain the cup holder 500 in an upright position. In one embodiment, a thickness of the downwardly extending arm 560 varies based on an amount of gap or space in between the one or more portions of the seating area (e.g., the thickness is thicker if the gap or space is wider). For example, in one embodiment, the downwardly extending arm 560 is designed and shaped to be removably inserted (i.e., wedged) in between a pair of seat cushions or seat pads of a seating area (e.g., sofa or couch cushions of a sofa or couch). As another example, in one embodiment, the downwardly extending arm 560 is designed and shaped to be removably inserted (i.e., wedged) in between an arm rest and a seat cushion or seat pad of a seating area. As yet another example, in one embodiment, the downwardly extending arm 560 is designed and shaped to be removably inserted (i.e., wedged) in between any pair of cushions, pillows, or pads (e.g., floor cushions or pillows positioned on a floor, pillows positioned on a bed, etc.).

To securely retain the cup holder 500 in an upright position, the downwardly extending arm 560 is inserted in between one or more portions of a seating area (e.g., in between sofa cushions of a sofa) until the bottom 510B of the receptacle 510 and/or the flared bottom 520B of the exterior surrounding sidewall 520 makes direct contact with and rests on top of the one or more portions of the seating area (e.g., rests on top of the sofa cushions). The flared bottom 520B of the exterior surrounding sidewall 520 functions as a support base for the receptacle 510 to maintain its position on the top of the one or more portions of the seating area. For example, if a portion of a drinking vessel is placed inside the receptable 510, a weight of the drinking vessel causes the flared bottom 520B to press/push against the top of the one or more portions of the seating area, thereby anchoring the receptacle 510. The diameter of the exterior surrounding sidewall 520 at the flared bottom 520B is wide enough to stabilize the receptacle 510 and prevent the entire receptacle 510 from falling into a gap or space in between the one or more portions of the seating area. In one embodiment, an underside of the bottom 510B and/or the flared bottom 520B includes one or more non-abrasive detachable attachment mechanisms, such as gripping pads or strips, to detachably attach the bottom 510B and/or the flared bottom 520B to the top of the one or more portions of the seating area.

In one embodiment, the height of the entire cup holder 500 (including the receptacle 510 and the downwardly extending arm 560) is sized to securely contain a drinking vessel of various sizes. For example, in one embodiment, the height of the entire cup holder 500 is substantially within a range of about 7 inches to about 7½ inches. For example, in one embodiment, the depth (or height) of the receptacle 510 is substantially within a range of about 3 inches to about 3½ inches.

In one embodiment, the downwardly extending arm 560 is substantially triangular and tapers outwardly as the downwardly extending arm 560 extends downwardly from the center of the bottom 510B of the receptacle 510. A width of the downwardly extending arm 560 increases as the downwardly extending arm 560 extends downwardly, i.e., the width at a top 560A of the downwardly extending arm 560 is narrower than the width at a bottom 560B of the downwardly extending arm 560. A height and a width of the downwardly extending arm 560 are sized to reduce a likelihood of the cup holder 500 becoming dislodged from a seating area when there is movement around one or more portions of the seating area that the downwardly extending arm 560 is inserted in between. For example, in one embodiment, the height of the downwardly extending arm 560 is substantially about 4 inches, the width of the downwardly extending arm 560 at the top 560A is substantially within a range of about 1½ inches to about 2 inches, and the width of the downwardly extending arm 560 at the bottom 560B is substantially about 3½ inches.

In one embodiment, the bottom 560B of the downwardly extending arm 560 has rounded corners as a safety feature (instead of sharp corners).

Figure 28:
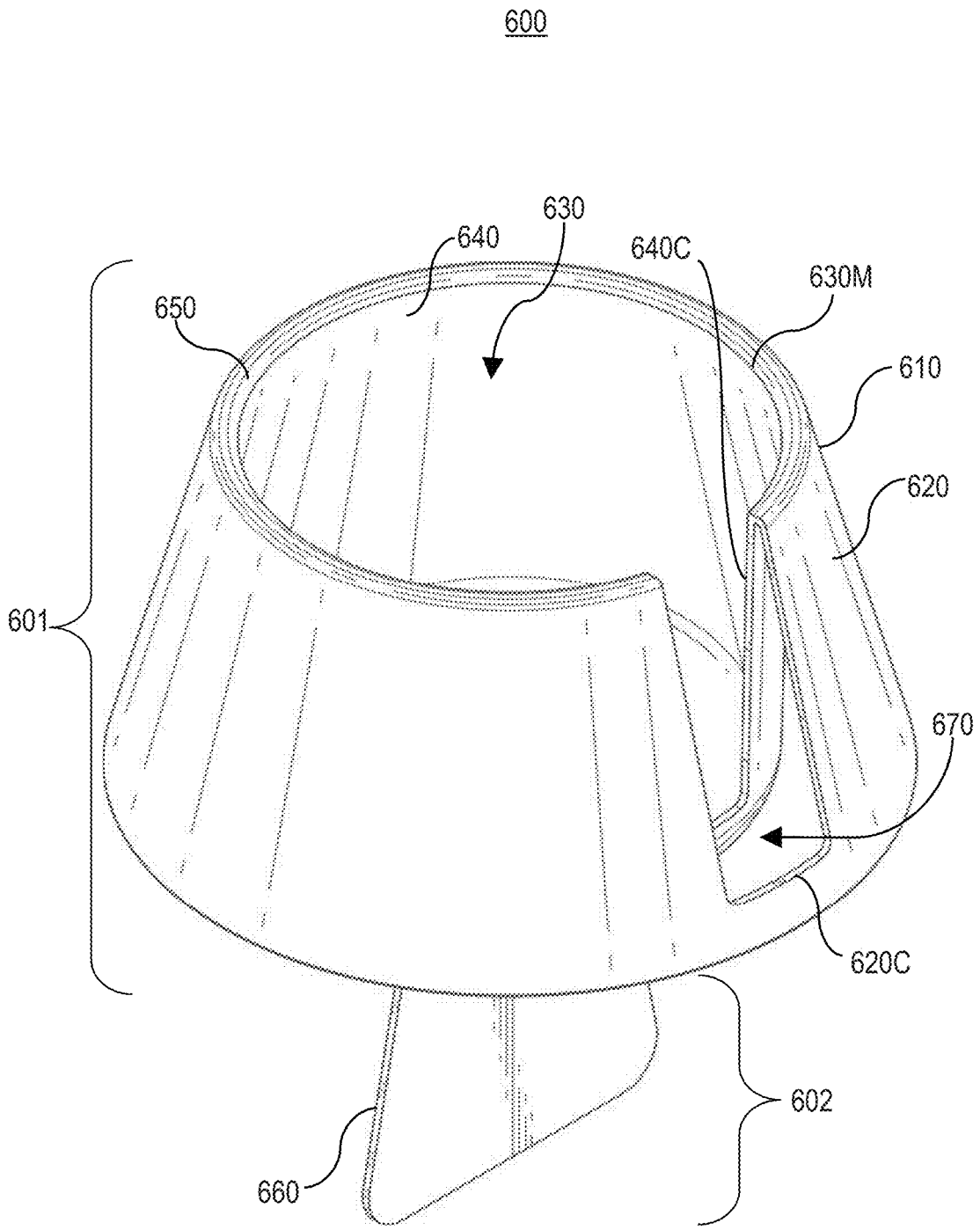
FIG. 28 is a perspective view of a sixth cup holder, in accordance with one embodiment.
Figure 29:
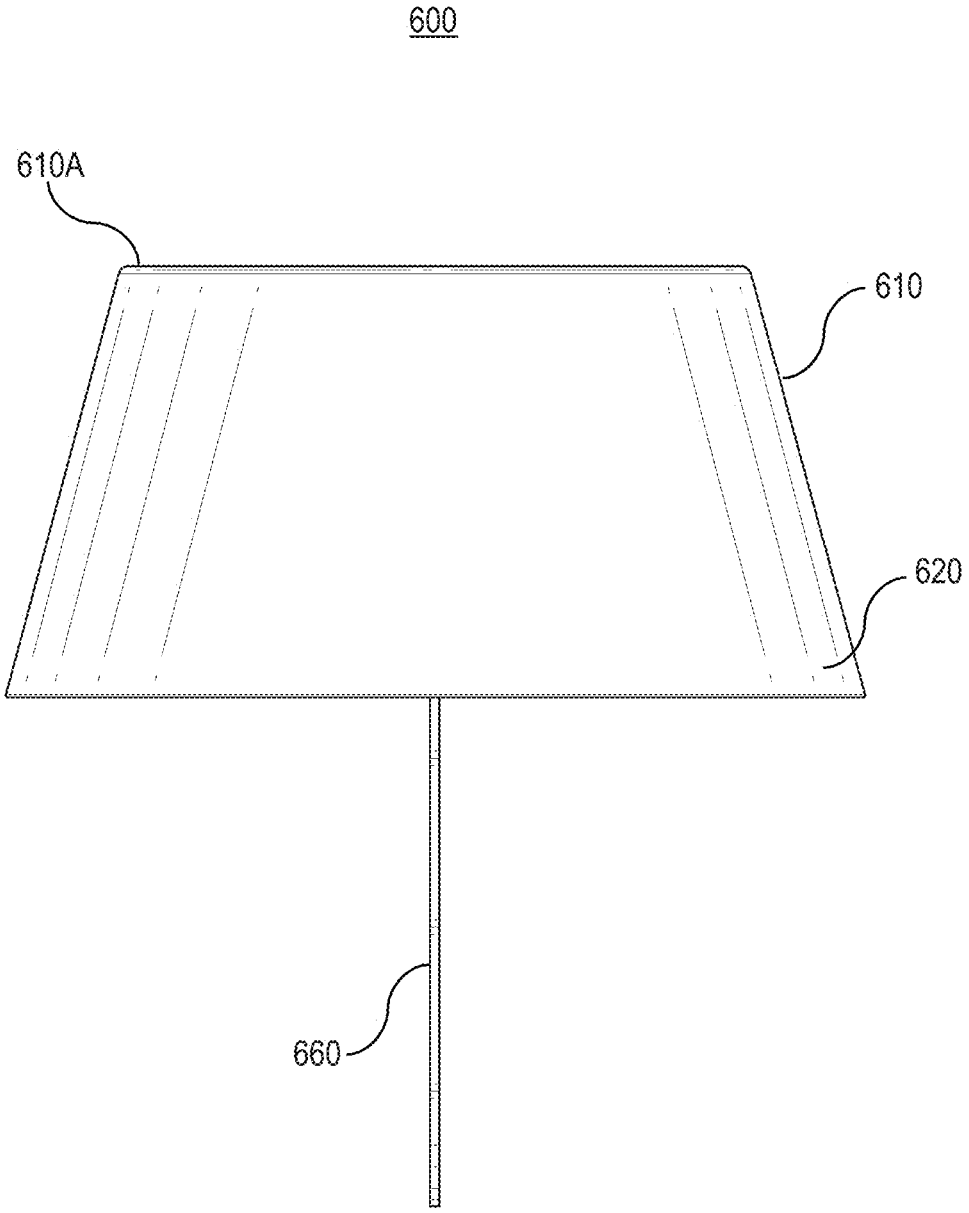
FIG. 29 is a side view of the sixth cup holder shown in FIG. 28, in accordance with one embodiment.
Figure 30:
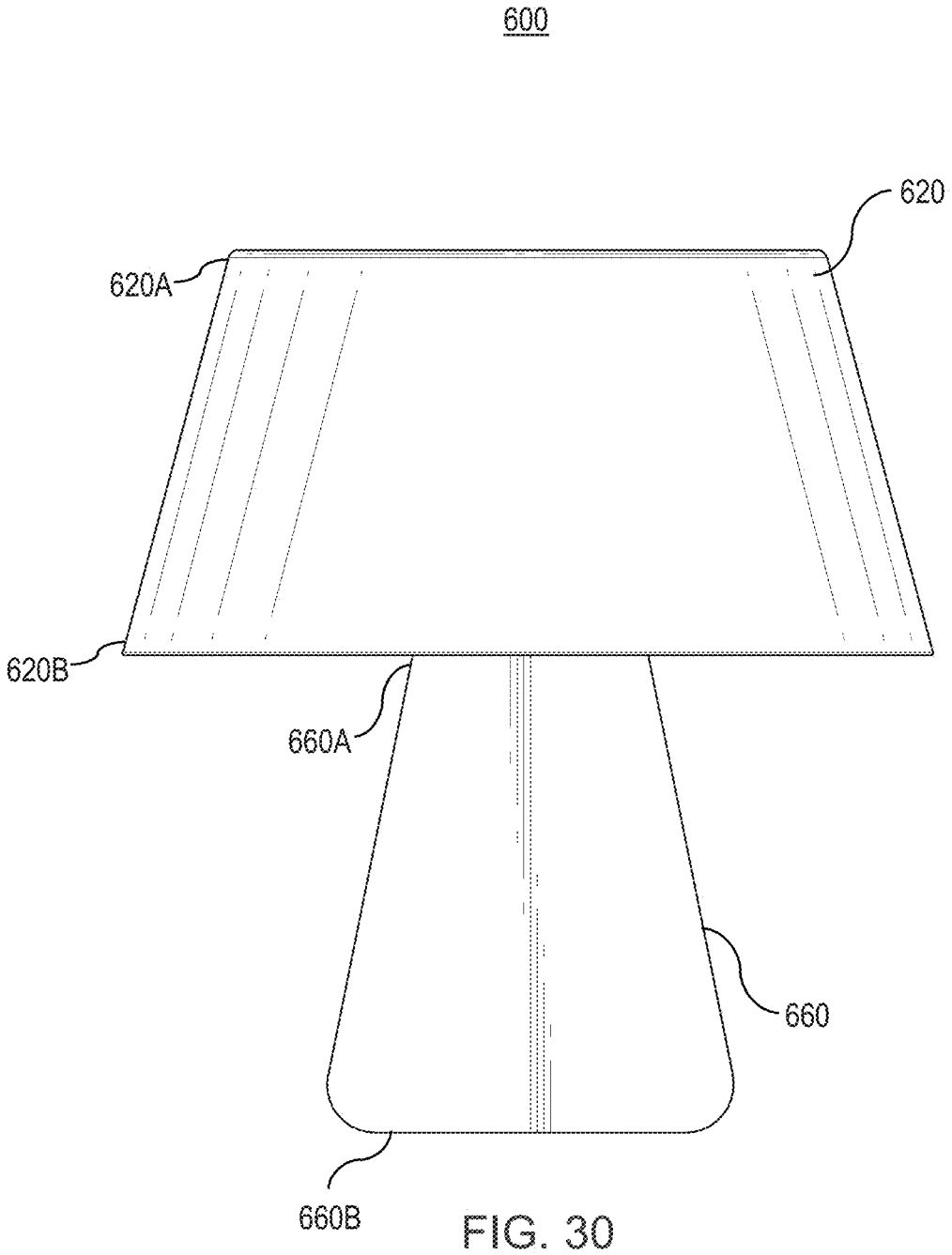
FIG. 30 is another side view of the sixth cup holder shown in FIG. 28, in accordance with one embodiment.
Figure 31:
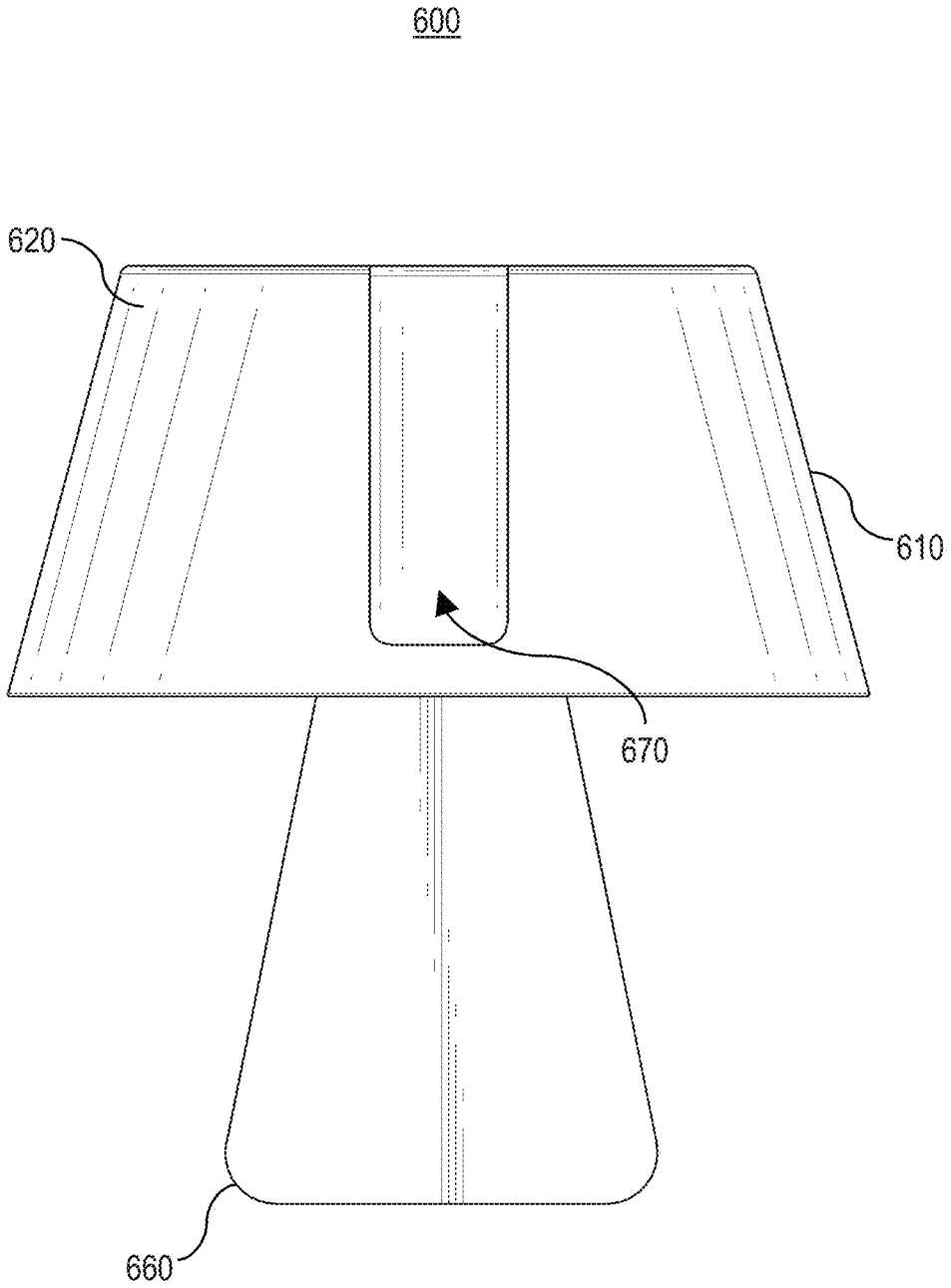
FIG. 31 is yet another side view of the sixth cup holder shown in FIG. 28, in accordance with one embodiment.
Figure 32:
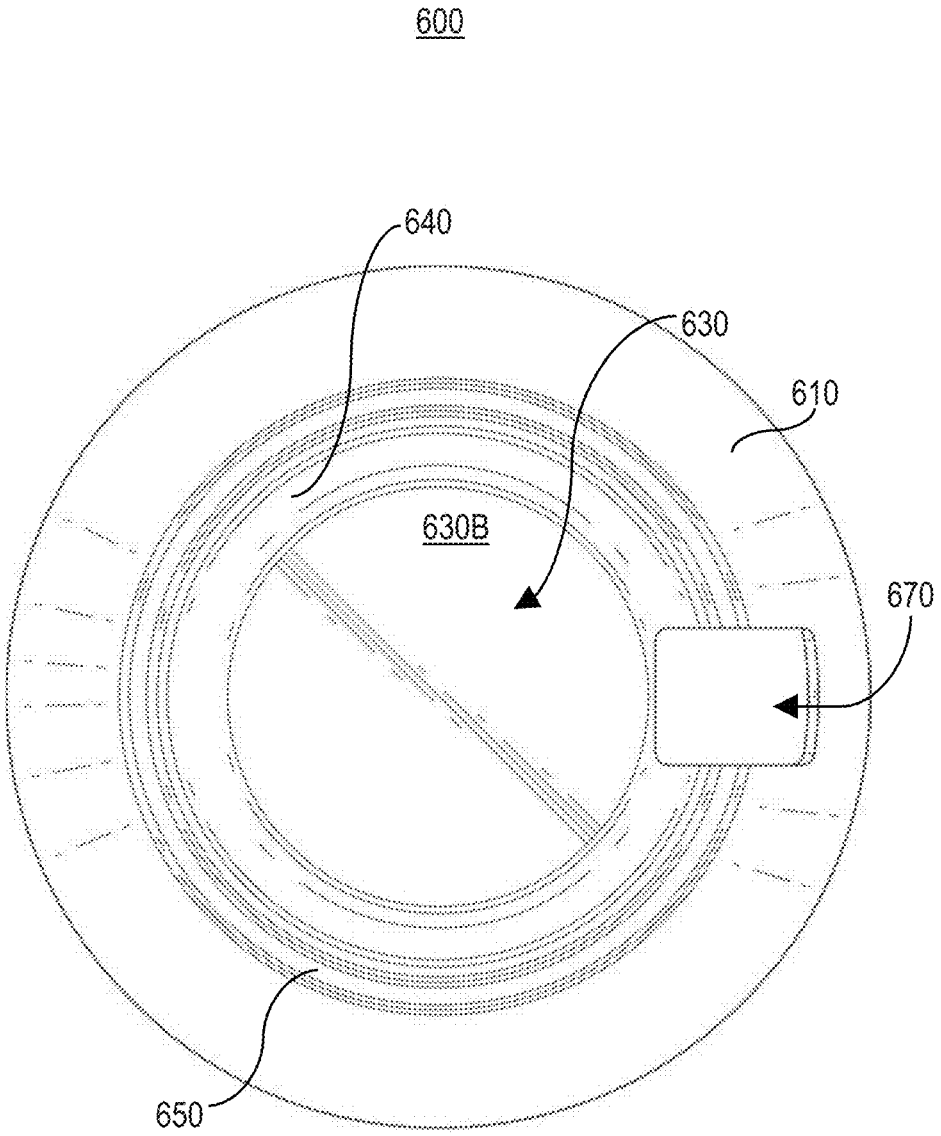
FIG. 32 is a top plan view of the sixth cup holder shown in FIG. 28, in accordance with one embodiment.
Figure 33:
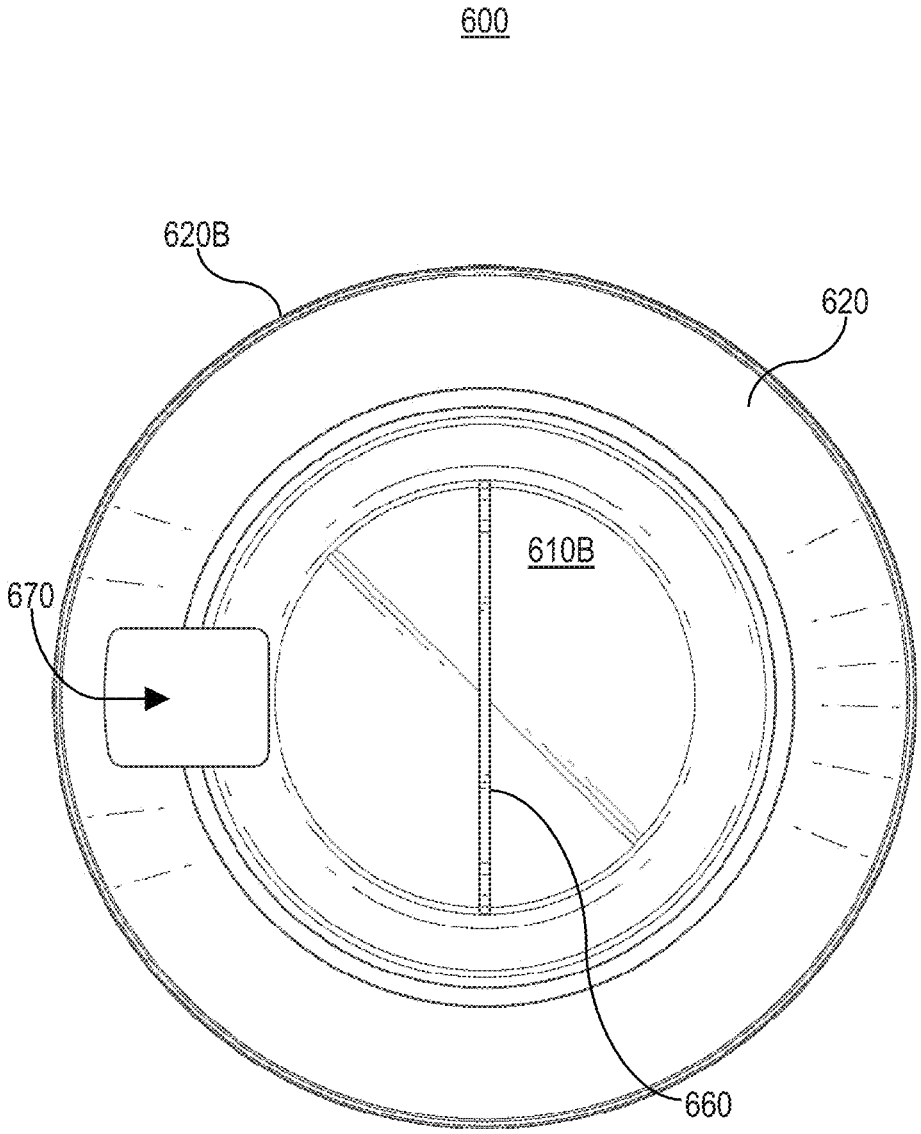
FIG. 33 is a bottom plan view of the sixth cup holder shown in FIG. 28, in accordance with one embodiment.

FIGS. 28-33 are different views of a cup holder 600, in accordance with one embodiment. FIG. 28 is a perspective view of the cup holder 600, in accordance with one embodiment. FIG. 29 is a side view of the cup holder 600, in accordance with one embodiment. FIG. 30 is another side view of the cup holder 600, in accordance with one embodiment. FIG. 31 is yet another side view of the cup holder 600, in accordance with one embodiment. FIG. 32 is a top plan view of the cup holder 600. FIG. 33 is a bottom plan view of the cup holder 600, in accordance with one embodiment. In one embodiment, the cup holder 600 comprises an upper end 601 and a lower end 602. The upper end 601 comprises a receptacle 610 inside of which a drinking vessel may be removably placed to contain the drinking vessel. The receptable 610 is designed and shaped to receive and contain different sizes and types of drinking vessels.

In one embodiment, the receptacle 610 comprises a hollow recess 630 with an open mouth 630M at a top 610A of the receptacle 610, an interior surrounding sidewall 640 below the open mouth 630M, and a substantially planar (i.e., flat) interior base wall 630B defining a bottom of the hollow recess 630. The interior surrounding sidewall 640 extends vertically between the open mouth 630M and the interior base wall 630B. The interior base wall 630B extends horizontally across the bottom of the hollow recess 630. The hollow recess 630, the interior surrounding sidewall 640, and the interior base wall 630B define an inner portion of the receptacle 610. The interior base wall 630B defines an interior surface of a bottom 610B of the receptacle 610.

The open mouth 630M is designed and shaped to receive a portion of a drinking vessel (e.g., a portion of a drinking vessel that includes a bottom of the drinking vessel). In one embodiment, the open mouth 630M is substantially circular with a diameter that is sized to receive a substantially cylindrical drinking vessel. For example, in one embodiment, the diameter of the open mouth 630M is substantially within a range of about 3 inches to about 4 inches. The diameter of the open mouth 630M is wider than the diameter of the open mouth 530M of the cup holder 500 (e.g., the diameter of the open mouth 630M is substantially about 4 inches, whereas the diameter of the open mouth 530M is substantially about 3 inches).

The hollow recess 630, the interior surrounding sidewall 640, and the interior base wall 630B are designed and shaped to securely contain a portion of a drinking vessel (e.g., a portion of a drinking vessel that includes a bottom of the drinking vessel). In one embodiment, the interior surrounding sidewall 640 and the hollow recess 630 are substantially cylindrical and the interior base wall 630B is substantially circular, all with a depth (or height) and/or a diameter that is sized to securely contain a substantially cylindrical drinking vessel of various sizes. For example, in one embodiment, the diameter of the interior base wall 630B, the diameter of the interior surrounding sidewall 640, and the diameter of the hollow recess 630 are substantially within a range of about 3 inches to about 4 inches. For example, in one embodiment, the depth (or height) of the interior surrounding sidewall 640 and the depth (or height) of the hollow recess 630 are substantially within a range of about 3 inches to about 3¼ inches. In one embodiment, the interior surrounding sidewall 640 is formed of a single continuous piece or of a plurality of separate pieces.

In one embodiment, the receptacle 610 further comprises a rim 650 defining a periphery of the open mouth 630M, and an exterior surrounding sidewall 620 extending downwardly from the rim 650. The rim 650 and the exterior surrounding sidewall 620 define an outer portion of the receptacle 610. In one embodiment, a thickness of the rim 650 varies. For example, in one embodiment, the thickness of the rim 650 is substantially within a range of about 2 cm to 3 cm.

In one embodiment, a bottom 620B of the exterior surrounding sidewall 620 is substantially coplanar with the bottom 610B of the receptacle 610. In another embodiment, the bottom 620B of the exterior surrounding sidewall 620 extends beyond the bottom 610B of the receptacle 610.

In one embodiment, the exterior surrounding sidewall 620 is substantially cylindrical. A diameter of the exterior surrounding sidewall 620 is larger than the diameter of the interior surrounding sidewall 640 and the hollow recess 630. In one embodiment, a thickness of the exterior surrounding sidewall 620 varies.

In one embodiment, the exterior surrounding sidewall 620 is flared, such that the exterior surrounding sidewall 620 outwardly tapers as the exterior surrounding sidewall 620 extends downwardly from the rim 650. The diameter of the exterior surrounding sidewall 620 increases as the exterior surrounding sidewall 620 extends downwardly, i.e., the diameter at a top 620A of the exterior surrounding sidewall 620 is narrower than the diameter at the flared bottom 620B of the exterior surrounding sidewall 620. The flared bottom 620B defines the widest part of the receptacle 610 which in turn defines the widest part of the entire cup holder 600. In one embodiment, the diameter of the exterior surrounding sidewall 620 at the flared bottom 620B (i.e., the diameter/width of the widest part of the receptacle 610/the entire cup holder 600) varies depending on an amount of stability required (e.g., the diameter is wider if more stability is required). For example, in one embodiment, the diameter of the exterior surrounding sidewall 620 at the flared bottom 620B (i.e., the diameter/width of the widest part of the receptacle 610/the entire cup holder 600) is substantially within a range of about 4½ inches to about 5½ inches. In one embodiment, the exterior surrounding sidewall 620 is formed of a single continuous piece or of a plurality of separate pieces.

In one embodiment, the interior surrounding sidewall 640 and the exterior surrounding sidewall 620 contain a cut out 640C and a cut out 620C, respectively. The cut out 640C extends vertically along the interior surrounding sidewall 640, starting at the top 610A of the receptacle 610 and terminating at a point within proximity of the bottom 610B of the receptacle 610 (the cut out 640C does not extend all the way to the bottom 610B). The cut out 640C extends vertically along the exterior surrounding sidewall 620, starting at the top 620A of the exterior surrounding sidewall 620 and terminating at a point within proximity of the bottom 620B of the exterior surrounding sidewall 620 (the cut out 620C does not extend all the way to the bottom 620B). The cut outs 640C and 620C are physically aligned to define a side cut out 670 configured to receive a handle of a drinking vessel (e.g., a handle of a cup or mug). In one embodiment, a width of the cut outs 640C and 620C, and in turn the side cut out 670, varies. For example, in one embodiment, the width of the side cut out 670 is substantially about 1 inch.

The receptacle 610 is designed and shaped to receive a portion of a drinking vessel (e.g., a bottom half of a drinking vessel) via the open mouth 630M, and securely retain the portion of the drinking vessel inside the receptacle 610 (i.e., inside the inner portion of the receptacle 610). If the drinking vessel has a handle, the drinking vessel is placed inside the receptacle 610 such that the handle slots into the side cut out 670. The depth (or height) and/or the diameter of the hollow recess 630, the interior surrounding sidewall 640, and the interior base wall 630B are sized to securely engage and retain the portion of the drinking vessel. The width of the cutouts 640C and 620C are sized to securely engage and retain the handle of the drinking vessel. The interior surround sidewall 640 and the side cut out 670 maintain the drinking vessel in an upright position and restrict movement of the drinking vessel, thereby preventing the drinking vessel from tipping and in turn reducing or preventing spillage of any liquids contained inside the drinking vessel.

In one embodiment, the lower end 602 comprises a downwardly extending arm 660 extending from the bottom 610B of the receptacle 610. In one embodiment, a top 660A of the downwardly extending arm 660 is attached or connected to a center of an exterior surface of the bottom 610B of the receptacle 610.

In one embodiment, the downwardly extending arm 660 is designed and shaped to be removably inserted (i.e., wedged) in between one or more portions of a seating area, such as a sofa or a couch, to securely retain the cup holder 600 in an upright position. In one embodiment, a thickness of the downwardly extending arm 660 varies based on an amount of gap or space in between the one or more portions of the seating area (e.g., the thickness is thicker if the gap or space is wider). For example, in one embodiment, the downwardly extending arm 660 is designed and shaped to be removably inserted (i.e., wedged) in between a pair of seat cushions or seat pads of a seating area (e.g., sofa or couch cushions of a sofa or couch). As another example, in one embodiment, the downwardly extending arm 660 is designed and shaped to be removably inserted (i.e., wedged) in between an arm rest and a seat cushion or seat pad of a seating area. As yet another example, in one embodiment, the downwardly extending arm 660 is designed and shaped to be removably inserted (i.e., wedged) in between any pair of cushions, pillows, or pads (e.g., floor cushions or pillows positioned on a floor, pillows positioned on a bed, etc.).

To securely retain the cup holder 600 in an upright position, the downwardly extending arm 660 is inserted in between one or more portions of a seating area (e.g., in between sofa cushions of a sofa) until the bottom 610B of the receptacle 610 and/or the flared bottom 620B of the exterior surrounding sidewall 620 makes direct contact with and rests on top of the one or more portions of the seating area (e.g., rests on top of the sofa cushions). The flared bottom 620B of the exterior surrounding sidewall 620 functions as a support base for the receptacle 610 to maintain its position on the top of the one or more portions of the seating area. For example, if a portion of a drinking vessel is placed inside the receptable 610, a weight of the drinking vessel causes the flared bottom 620B to press/push against the top of the one or more portions of the seating area, thereby anchoring the receptacle 610. The diameter of the exterior surrounding sidewall 620 at the flared bottom 620B is wide enough to stabilize the receptacle 610 and prevent the entire receptacle 610 from falling into a gap or space in between the one or more portions of the seating area. In one embodiment, an underside of the bottom 610B and/or the flared bottom 620B includes one or more non-abrasive detachable attachment mechanisms, such as gripping pads or strips, to detachably attach the bottom 610B and/or the flared bottom 620B to the top of the one or more portions of the seating area.

In one embodiment, the height of the entire cup holder 600 (including the receptacle 610 and the downwardly extending arm 660) is sized to securely contain a drinking vessel of various sizes. For example, in one embodiment, the height of the entire cup holder 600 is substantially within a range of about 7 inches to about 7½ inches. For example, in one embodiment, the depth (or height) of the receptacle 610 is substantially within a range of about 3 inches to about 3½ inches.

In one embodiment, the downwardly extending arm 660 is substantially triangular and tapers outwardly as the downwardly extending arm 660 extends downwardly from the center of the bottom 610B of the receptacle 610. A width of the downwardly extending arm 660 increases as the downwardly extending arm 660 extends downwardly, i.e., the width at a top 660A of the downwardly extending arm 660 is narrower than the width at a bottom 660B of the downwardly extending arm 660. A height and a width of the downwardly extending arm 660 are sized to reduce a likelihood of the cup holder 600 becoming dislodged from a seating area when there is movement around one or more portions of the seating area that the downwardly extending arm 660 is inserted in between. For example, in one embodiment, the height of the downwardly extending arm 660 is substantially about 4 inches, the width of the downwardly extending arm 660 at the top 660A is substantially within a range of about 1½ inches to about 2 inches, and the width of the downwardly extending arm 660 at the bottom 660B is substantially about 3½ inches.

In one embodiment, the bottom 660B of the downwardly extending arm 660 has rounded corners as a safety feature (instead of sharp corners).

Figure 34:
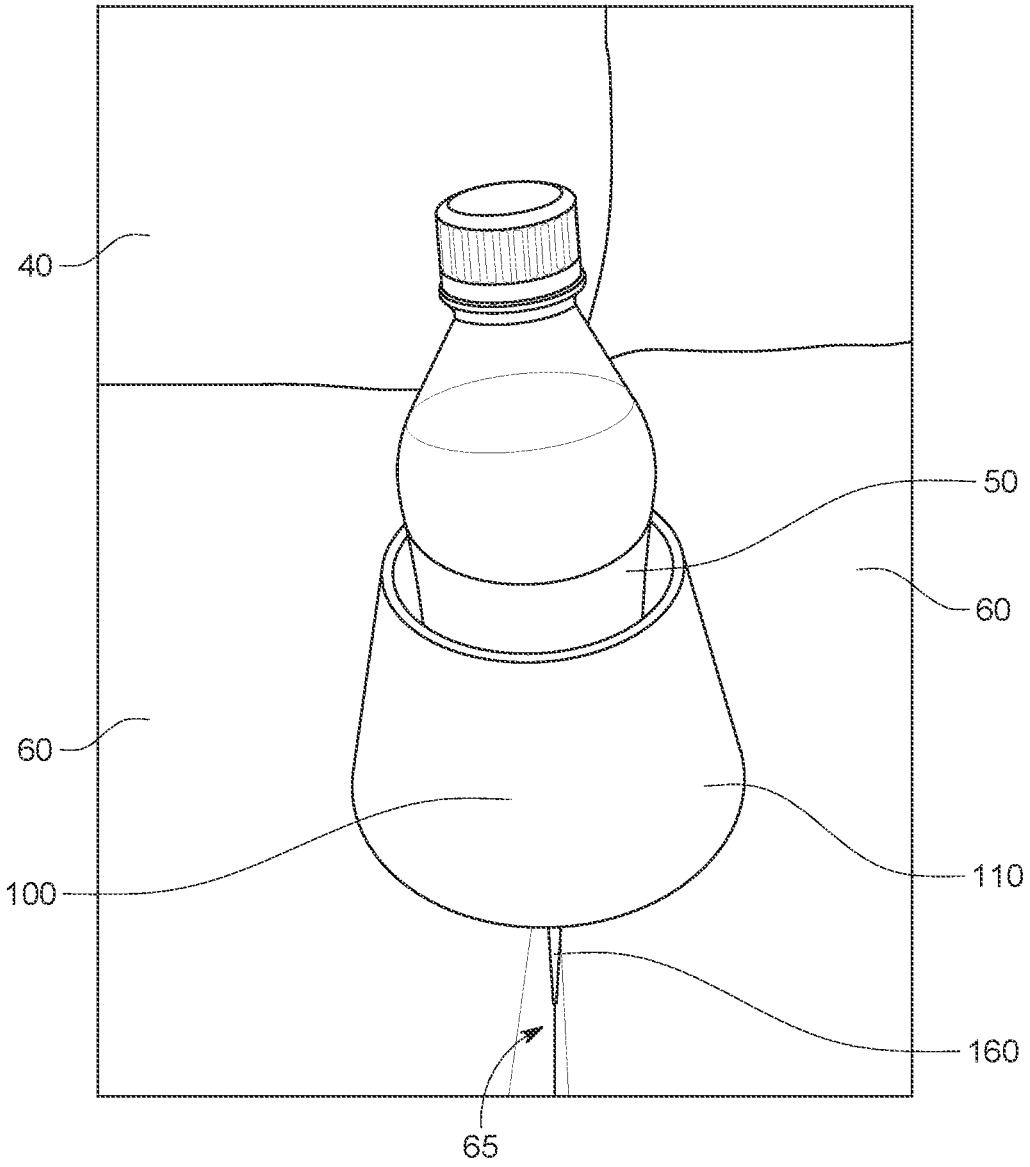
FIG. 34 shows the first cup holder positioned to rest on top of sofa cushions of a sofa, in accordance with one embodiment.

FIG. 34 shows the cup holder 100 positioned to rest on top of sofa cushions 60 of a sofa 40, in accordance with one embodiment. As shown in FIG. 34, the downwardly extending arm 160 of the cup holder 100 is inserted (wedged) into a gap 65 in between the sofa cushions 60. A drinking vessel 50 is contained inside the receptacle 110 of the cup holder 100.

Each cup holder 100, 200, 300, 400, 500, and 600 removes the necessity of a user physically holding the drinking vessel or placing the drinking vessel upon a table. Each cup holder 100, 200, 300, 400, 500, and 600 can be used with a seating area that does not have a built-in cup holder. Each cup holder 100, 200, 300, 400, 500, and 600 allows a user to sit on a seating area and safely place a drinking vessel, via the cup holder, on the same seating area without having to worry about liquid spilling from the drinking vessel.

Each cup holder 100, 200, 300, 400, 500, and 600 may be positioned to rest on top of one or more portions of a seating area with or without a drinking vessel already placed inside its receptacle.

In one embodiment, each cup holder 100, 200, 300, 400, 500, and 600 is made out of one or more materials, such as any type of plastic materials, rubber materials, metal materials, etc.

In one embodiment, each cup holder 100, 200, 300, 400, 500, and 600 is dishwasher safe.

In one embodiment, components of each cup holder 100, 200, 300, 400, 500, and 600 are separate, detachable, and interchangeable. For example, the flange 270 of the cup holder 200 and the one or more fins 370 of the cup holder 300 are detachable. As another example, each downwardly extending arm of each cup holder 100, 200, 300, 400, 500, and 600 is detachable from a receptacle of the same cup holder.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A cup holder device comprising:

a receptacle comprising:

an inner portion including a hollow recess with an open mouth at a top of the receptacle, an interior base wall defining a bottom of the hollow recess, and an interior surrounding sidewall extending vertically between the open mouth and the interior base wall, wherein the inner portion is shaped to receive and retain a drinking vessel; and an outer portion including an exterior surrounding sidewall, wherein the exterior surrounding sidewall extends downwardly from a rim at a periphery of the open mouth, the exterior surrounding sidewall outwardly tapers as the exterior surrounding sidewalls extends downwardly from the rim, and a diameter of the exterior surrounding sidewall is wider at a bottom of the exterior surrounding sidewall than at a top of the exterior surrounding sidewall; and an arm extending downwardly from a bottom of the receptacle, wherein the arm is shaped to insert in between one or more portions of a seating area, and the outer portion makes direct contact with and rests on top of the one or more portions of the seating area when the arm is inserted in between the one or more portions of the seating area.

2. The device of claim 1, wherein the bottom of the exterior surrounding sidewall prevents the receptacle from falling into a gap in between the one or more portions of the seating area.

3. The device of claim 1, wherein the outer portion further includes a flange extending substantially radially outward from the bottom of the exterior surrounding sidewall, and the bottom of the exterior surrounding sidewall and the flange prevent the receptacle from falling into a gap in between the one or more portions of the seating area.

4. The device of claim 1, wherein the exterior surrounding sidewall is substantially planar as the exterior surrounding sidewalls extends downwardly from the rim.

5. The device of claim 4, wherein the outer portion further includes one or more fins extending substantially radially outward from a bottom of the exterior surrounding sidewall, and the bottom of the exterior surrounding sidewall and the one or more fins prevent the receptacle from falling into a gap in between the one or more portions of the seating area.

6. The device of claim 1, wherein the interior surrounding sidewall and the exterior surrounding sidewall include a first cut out and a second cut out, respectively, that are physically aligned to define a side cut out shaped to receive a handle of the drinking vessel.

7. A cup holder comprising:

a receptacle comprising:

an inner portion including a hollow recess with an open mouth at a top of the receptacle, an interior base wall defining a bottom of the hollow recess, and an interior surrounding sidewall extending vertically between the open mouth and the interior base wall, wherein the inner portion is shaped to receive and retain a drinking vessel; and an outer portion including an exterior surrounding sidewall, wherein the exterior surrounding sidewall extends downwardly from a rim at a periphery of the open mouth, the exterior surrounding sidewall outwardly tapers as the exterior surrounding sidewalls extends downwardly from the rim, and a diameter of the exterior surrounding sidewall is wider at a bottom of the exterior surrounding sidewall than at a top of the exterior surrounding sidewall; and an arm extending downwardly from a bottom of the receptacle, wherein the arm is shaped to insert in between one or more portions of a seating area, and the outer portion makes direct contact with and rests on top of the one or more portions of the seating area when the arm is inserted in between the one or more portions of the seating area.

8. The cup holder of claim 7, wherein the bottom of the exterior surrounding sidewall prevents the receptacle from falling into a gap in between the one or more portions of the seating area.

9. The cup holder of claim 7, wherein the outer portion further includes a flange extending substantially radially outward from the bottom of the exterior surrounding sidewall, and the bottom of the exterior surrounding sidewall and the flange prevent the receptacle from falling into a gap in between the one or more portions of the seating area.

10. The cup holder of claim 7, wherein the exterior surrounding sidewall is substantially planar as the exterior surrounding sidewalls extends downwardly from the rim.

11. The cup holder of claim 10, wherein the outer portion further includes one or more fins extending substantially radially outward from a bottom of the exterior surrounding sidewall, and the bottom of the exterior surrounding sidewall and the one or more fins prevent the receptacle from falling into a gap in between the one or more portions of the seating area.

12. The cup holder of claim 7, wherein the interior surrounding sidewall and the exterior surrounding sidewall include a first cut out and a second cut out, respectively, that are physically aligned to define a side cut out shaped to receive a handle of the drinking vessel.

13. A cup holder system comprising:

a receptacle comprising:

an inner portion including a hollow recess with an open mouth at a top of the receptacle, an interior base wall defining a bottom of the hollow recess, and an interior surrounding sidewall extending vertically between the open mouth and the interior base wall, wherein the inner portion is shaped to receive and retain a drinking vessel; and an outer portion including an exterior surrounding sidewall, wherein the exterior surrounding sidewall extends downwardly from a rim at a periphery of the open mouth, the exterior surrounding sidewall outwardly tapers as the exterior surrounding sidewalls extends downwardly from the rim, and a diameter of the exterior surrounding sidewall is wider at a bottom of the exterior surrounding sidewall than at a top of the exterior surrounding sidewall; and an arm extending downwardly from a bottom of the receptacle, wherein the arm is shaped to insert in between one or more portions of a seating area, and the outer portion makes direct contact with and rests on top of the one or more portions of the seating area when the arm is inserted in between the one or more portions of the seating area.

14. The cup holder system of claim 13, wherein the bottom of the exterior surrounding sidewall prevents the receptacle from falling into a gap in between the one or more portions of the seating area.

* * * * *